US007252447B2

(12) United States Patent
Kimura et al.

(10) Patent No.: US 7,252,447 B2
(45) Date of Patent: Aug. 7, 2007

(54) PRINTING APPARATUS

(75) Inventors: Satoshi Kimura, Ome (JP); Yoshiaki Mochizuki, Mizuho-machi (JP)

(73) Assignee: Casio Computer Co., Ltd., Tokyo (JP)

( * ) Notice: Subject to any disclaimer, the term of this patent is extended or adjusted under 35 U.S.C. 154(b) by 120 days.

(21) Appl. No.: 11/249,101

(22) Filed: Oct. 12, 2005

(65) Prior Publication Data

US 2006/0078364 A1 Apr. 13, 2006

(30) Foreign Application Priority Data

Oct. 13, 2004 (JP) ..... 2004-299326

(51) Int. Cl.
*B41J 11/00* (2006.01)

(52) U.S. Cl. ..... 400/621; 400/76

(58) Field of Classification Search ..... 400/621, 400/76

See application file for complete search history.

(56) References Cited

U.S. PATENT DOCUMENTS 6,709,175 B1 * 3/2004 Drynkin et al. ..... 400/48
6,857,797 B2 * 2/2005 Weast ..... 400/61
2006/0078366 A1 4/2006 Kimura et al.

FOREIGN PATENT DOCUMENTS

JP 2003-072173 A 3/2003
JP 2003-072175 3/2003

* cited by examiner

*Primary Examiner*—Minh Chau
(74) *Attorney, Agent, or Firm*—Frishauf, Holtz, Goodman & Chick, P.C.

(57) ABSTRACT

When a thermal head prints on a print tape with a tape cassette retained in a receiving section of a main body, the print tape undergone printing is cut by a stationary blade and a movable blade of a cutting mechanism, and when the thermal head performs printing on an optical disk retained in the receiving section of the main body, the cutting section does not operate to the optical disk undergone printing.

13 Claims, 20 Drawing Sheets

PRINTING APPARATUS

BACKGROUND OF THE INVENTION

1. Field of the Invention

The present invention relates to a printing apparatus which prints on a print tape as well as a hard medium like a recording medium.

2. Description of the Related Art

Printing apparatuses for an optical disk, which perform printing on the label side of a recording medium, such as an optical disk, have been developed. Unexamined Japanese Patent Application KOKAI Publication JP 2003-72175 discloses a printing apparatus which performs printing on an optical disk. The printing apparatus comprises a tray which supports an optical disk, and a printing mechanism which performs printing on the optical disk supported by the tray.

The tray is so provided as to be movable between the interior of a main body and the exterior thereof. The printing mechanism has a movable carriage. The carriage is located at a predetermined position in the main body, and moves on the tray retained in the main body. A thermal head is mounted on the carriage, and an ink ribbon cassette holding an ink ribbon is detachably mounted on the carriage. The printing apparatus performs thermal transfer printing on an optical disk, supported on the tray placed in the main body, using the ink ribbon by the thermal head which is mounted on the carriage and moves.

There are widely used printing apparatuses for tape printing, which print on a print tape and cut the tape to produce labels. According to this type of printing apparatus, a tape cassette holding a print tape and an ink ribbon is mounted in a cassette receiving section in the main body, the thermal head is driven to perform thermal transfer printing on the print tape fed out, using the ink ribbon, and the printed print tape is discharged out of the main body from a discharge port and is then cut by a cutter provided near the discharge port, providing a label. Such a printing apparatus which prints on a print tape is disclosed in, for example, Unexamined Japanese Patent Application KOKAI Publication JP 7-314747.

There may be a case where it is desirable for the management purpose that a string of characters like a title should be printed on the label side of an optical disk and a label having the same string of characters printed thereon as the character string printed on the label side of the optical disk should be pasted on a disk storage case for the optical disk.

In such a case, a character string like a title relating to the contents of electronic data recorded on the optical disk is printed on the label side of the optical disk with the printing apparatus for an optical-disk printing, and a label is created by printing the same character string as the one printed on the optical disk on a tape using the printing apparatus for tape printing, and the label is pasted on a disk storage case for the optical disk.

In a case where printing is directly performed on the label side of an optical disk and printing is performed on a tape for a label to be passed on a disk case as discussed previously, however, discrete printing with two printing apparatuses, one for optical-disk printing and the other for tape printing, are required.

Often is a case where it is required to print a necessary character string on the label side of an optical disk, or print such a character string on a labeling tape, regardless of the relationship between an optical disk and its storage case. In this case, two printing apparatuses of different kinds should also be prepared.

The inventors of the present invention have made an intensive study on a printing apparatus which has a single thermal head and a single printing section, and can print on an optical disk and a print tape for creating a label.

Because such a printing apparatus has a capability of printing on a print tape, the printing apparatus has a cutting mechanism. If printing on a print tape to be cut and printing on an optical disk which cannot be cut are carried out with a common printing section, however, the operation of the cutting mechanism, when operated at the time of printing on the optical disk, may damage the optical disk, or the cutting mechanism designed for cutting a sheet-like print tape may break down when used on the optical disk.

SUMMARY OF THE INVENTION

It is an object of the invention to provide a printing apparatus which can print on different print targets, such as a print tape and a hard medium, with a single printing section, and cuts a printed portion of the print tape by a cutter after printing on that tape, and controls the cutter not to operate after printing on the medium, thereby avoiding a damage on the medium by the cutter, and a failure of the cutter.

To achieve the object, there is provided a printing apparatus according to the invention which selectively printing on a print tape and a hard medium as different print targets and comprises a single printing section which can perform printing on the print tape or the medium, a cutter which cuts the print tape on which printing is performed by the printing section, a detector which detects the print target retained in a main body, and a controller which controls the printing section and the cutter, activates the printing section and performs printing on the print tape or the medium, and permits or inhibits an operation of the cutter based on detection information of the print tape or the medium detected by the detector.

According to the above-described structure of the printing apparatus, for example, it is controlled in such a way that printing and cutting are performed on the print tape to be cut after printing, and only printing is performed and cutting is not performed on the hard medium which should not be cut, the hard medium is not broken by the cutting, and it is possible to eliminate a disadvantage such as a failure of the cutter originating from the operation of the cutter, adapted for the print tape, on the hard medium for which the cutter is not adapted.

In the structure, the printing apparatus further comprises a printing-mode-setting section which sets a first printing mode of printing on the print tape, and a second printing mode for printing on the medium, wherein the controller activates the printing section to print on the print tape and activates the cutter for cutting the print tape on which printing is performed by the printing section when the first printing mode is set by the printing mode setting section and the detection section detects the print tape as the print target, and activates the printing section to print on the medium and performs controlling as to inhibit the operation of the cutter when the second printing mode is set by the printing mode setting section and the detection section detects the medium as the print target.

According to this structure, when the first printing mode of printing on the print tape is set, and the print tape is detected as the print target, the printing section and the cuter are operated and a label can be created, and when the second printing mode of printing on the hard medium, and the hard medium is detected as the print target, the printing section is operated to carry out label printing and the operation of the cutter on the hard medium is inhibited, thereby preventing the hard medium from being cut and broken.

In the structure, the printing apparatus further comprises an alarm section which alarms an error when the first printing mode is set by the printing mode setting section but the detection section detects that the print target is not the print tape, and when the second printing mode is set by the printing-mode-setting section but the detection section detects that the print target is not the medium.

According to the structure, error alarming is carried out when the first printing mode of printing on the print tape is set, but what is detected as the print target is not the print tape, and when the second printing mode of printing on the hard medium, but what is detected as the print target is not the hard medium, thereby ensuring a prevention of a print error resulting from printing in a printing mode not corresponding to the print target.

In the structure, the controller inhibits operations of the printing section and cutter when the first printing mode is set by the printing mode setting section but the detection section detects that the print target is not the print tape, and when the second printing mode is set by the printing mode setting section but the detection section detects that the print target is not the medium.

According to this structure, the operation of the cutter is inhibited when the first printing mode of printing on the print tape is set but what is detected as the print target is not the print tape, and the second printing mode of printing on the hard medium but what is detected as the print target is not the hard medium, thereby ensuring prevention of a print error resulting from a printing in a printing mode not corresponding to the print target.

In the structure, the printing apparatus further comprises a cutting-mode setting section which can set a first cutting mode of cutting the print target and a second cutting mode of not cutting the print target, wherein in a case where the first cutting mode is set by the cutting-mode setting section, the controller performs controlling as to permit operations of the printing section and cutter when the detection section detects the print tape as the print target, and performs controlling as to permit the operation of the printing section and inhibit the operation of the cutter when the detection section detects the medium as the print target.

According to the structure, the cutting mode of deciding whether or not cutting is carried out and the kind of the print target to be processed is detected, and when it is detected that the process object is the hard medium not to be cut, and only printing is performed and cutting is not performed even if the mode of cutting is set. Accordingly, the hard medium is not broken by cutting it, and it is possible to eliminate a disadvantage such as a cause of a failure on the cutter resulting from the operation of the cutter which is so provided as to correspond to the print tape to the non-accommodated hard medium.

In the structure, the printing apparatus further comprises a forced-operation instruction section which generates an instruction to force the cutter to operate, wherein the controller activates the cutter in accordance with the instruction from the forced-operation instruction section when the detection section detects the print tape, and inhibits the operation of the cutter regardless of the instruction of the forced-operation instruction section when the detection section detects the medium.

According to the structure, even if the instruction to force the cutter to operate is given, the operation of the cutter is inhibited in a case where the hard medium is retained in the main body, and it is possible to prevent the hard medium from being accidentally cut and broken.

In the structure, the printing section has a thermal head, the print tape is held together with an ink ribbon by a tape cassette and retained in the main body, and the medium is retained in the main body together with a ribbon cassette holding an ink ribbon, and the printing section thermally transfers ink of the ink ribbon onto the print tape and ink of the ink ribbon of the ribbon cassette onto the medium.

According to this structure, the printing apparatus of the embodiment can be adapted to a thermal transfer printing apparatus.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENT

Preferred embodiments of the present invention will be described below with reference to the accompanying drawings.

Figure 1:
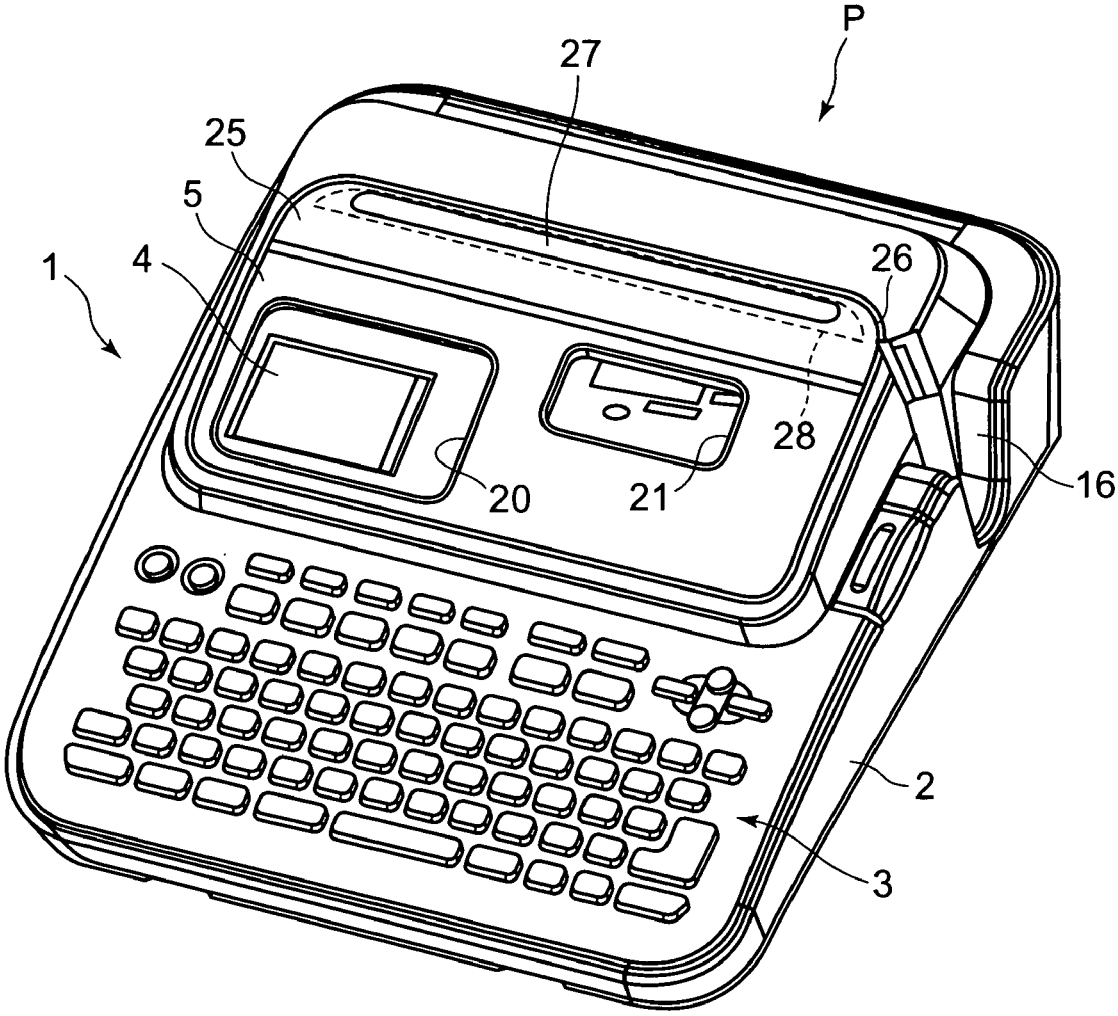
FIG. 1 is a perspective view illustrating a state where a receiving-section cover of a printing apparatus according to one embodiment of the present invention is closed.
Figure 2:
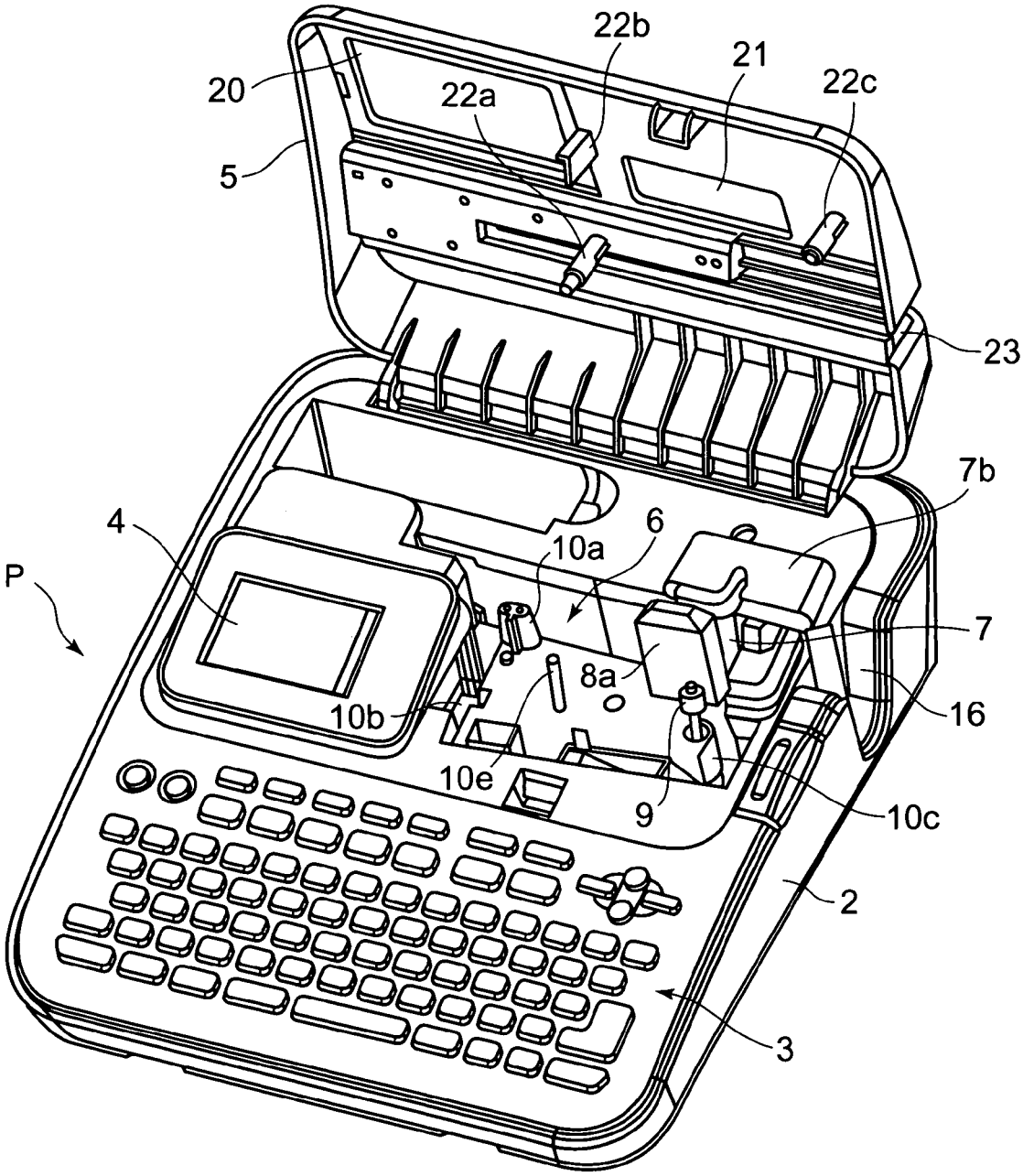
FIG. 2 is a perspective view illustrating the receiving-section cover of the printing apparatus open.
Figure 3:
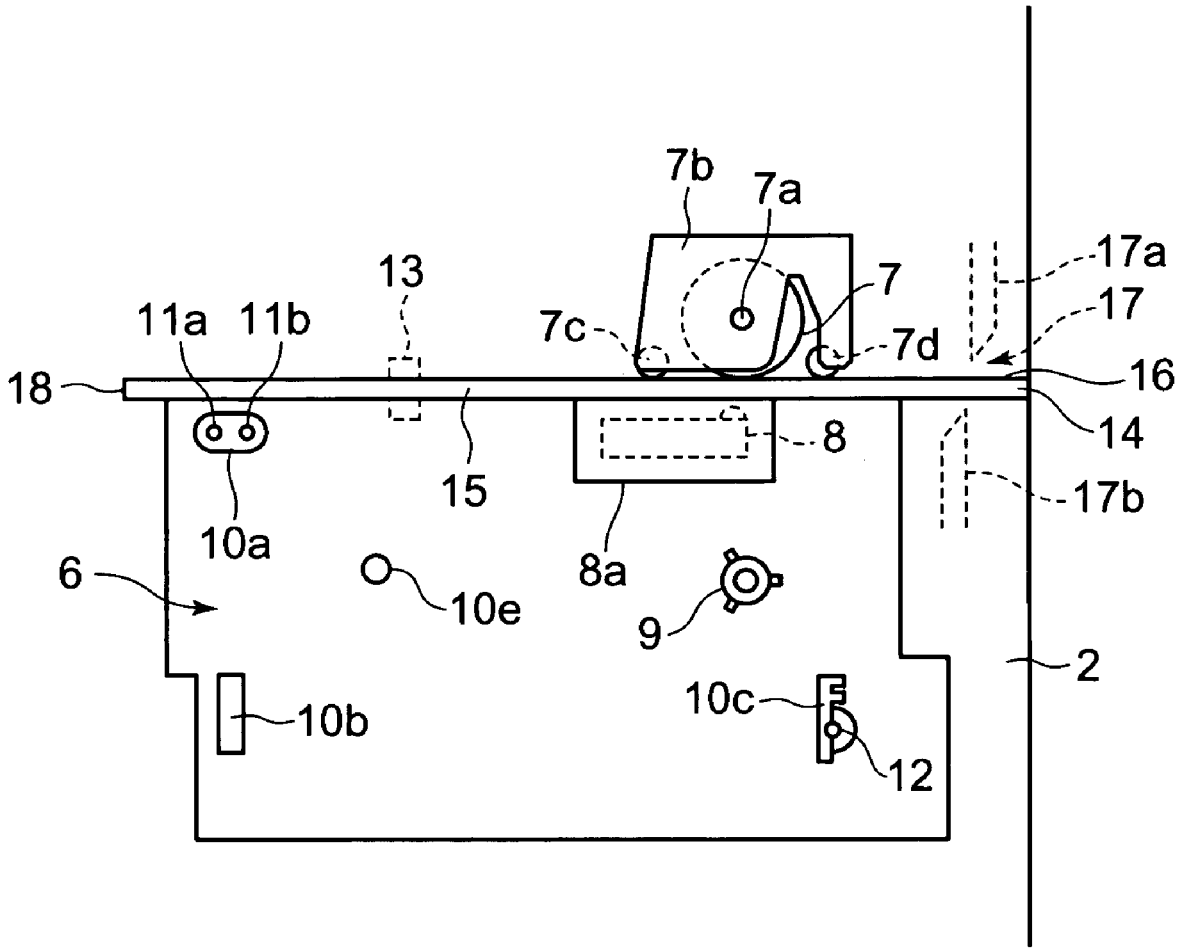
FIG. 3 is a plan view of a receiving section of the printing apparatus.

FIG. 1 is a perspective view illustrating a state where a receiving-section cover of a printing apparatus P according to one embodiment of the present invention is closed, and FIG. 2 is a general perspective view illustrating the receiving-section cover of the printing apparatus P open. FIG. 3 is a plan view of a receiving section provided at the printing apparatus.

The printing apparatus P can print on a print tape, and print on the surface of a recording medium, such as a CD-R (Compact Disk Recordable), CD-RW (Compact Disk ReWritable), DVD-R (Digital Versatile Disk Recordable), or DVD-RW (Digital Versatile Disk ReWritable), and a resin card, which can record electronic data.

As shown in FIG. 1, the printing apparatus P comprises a main body 1 having a body case 2 and a receiving-section cover 5. A key input section 3 and a display section 4 are provided on the top surface of the body case 2 of the main body 1. The key input section 3 has character keys for inputting data of a sequence of characters to be printed on a print tape or an optical disk, a print key to instruct the initiation of printing, cursor keys to move a cursor on the display screen of the display section 4, a cutter key to forcibly operate a cutting mechanism, and various control keys needed for editing a sequence of characters input, various setting processes, a printing process, and the like. The display section 4 is a liquid crystal display apparatus which displays data input from the key input section 3, and setting screens and messages relating to printing.

The body case 2 of the main body 1 has a single receiving section 6 for receiving a cassette and an optical disk. The top surface of the receiving section 6 is open for mounting and dismounting a cassette, and the opening is opened and closed by the receiving-section cover 5 provided on the top surface.

Figure 4A:
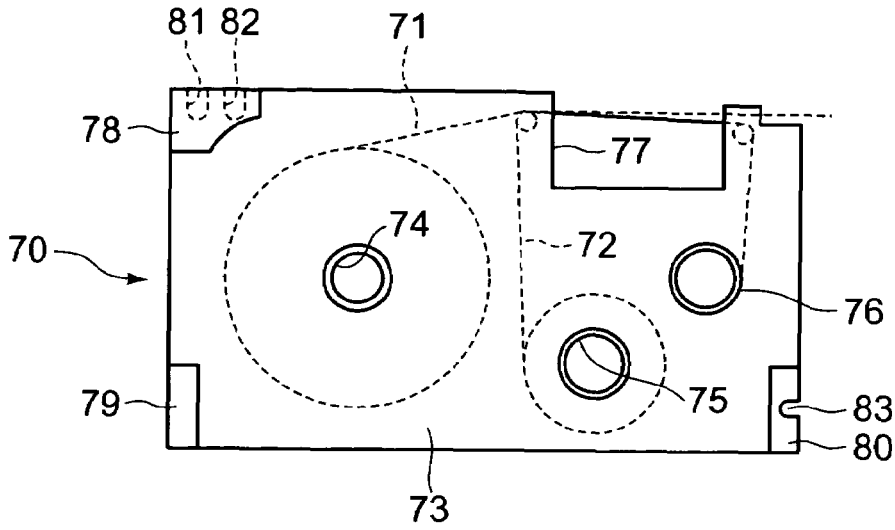
FIG. 4A is a plan view of a tape cassette for use in the printing apparatus.
Figure 4B:
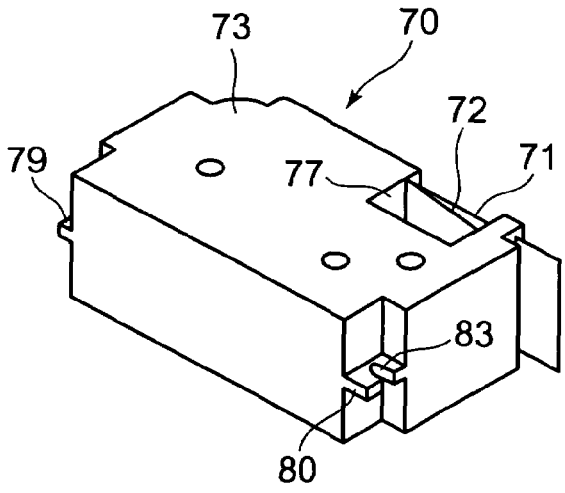
FIG. 4B is a perspective view of the tape cassette for use in the printing apparatus.
Figure 5A:
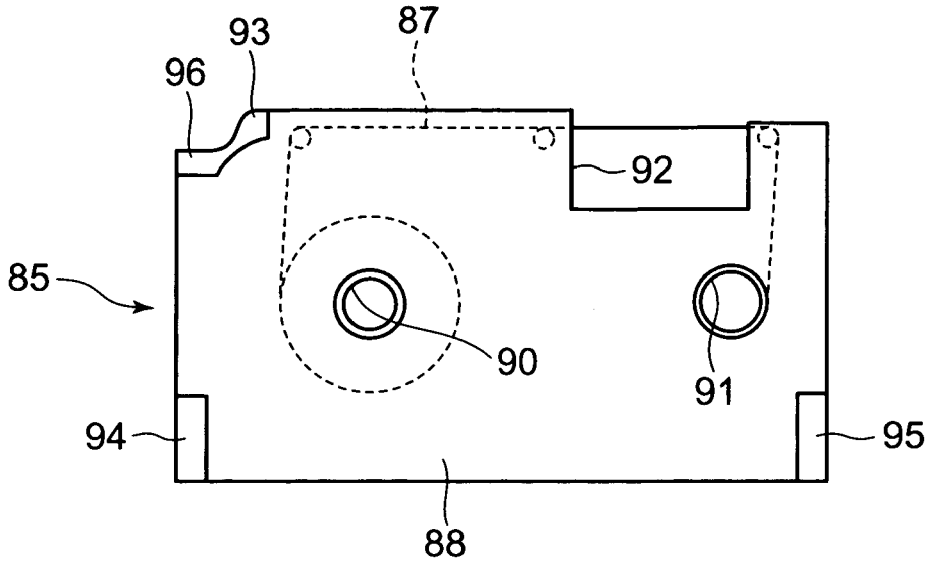
FIG. 5A is a plan view of a ribbon cassette for use in the printing apparatus.
Figure 5B:
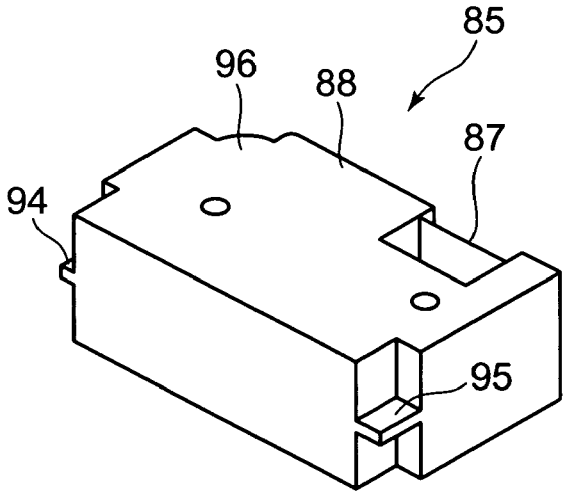
FIG. 5B is a perspective view of the ribbon cassette for use in the printing apparatus.

A tape cassette 70, shown in FIGS. 4A and 4B, and a ribbon cassette 85, shown in FIGS. 5A and 5B, are selectively received in the receiving section 6. The tape cassette 70 and the ink ribbon cassette 85 have approximately the same outside diameters. The tape cassette 70 holds a print tape 71 and an ink ribbon 72 in a cassette case 73. The ribbon cassette 85 holds an ink ribbon 87 in a cassette case 88. Plural types of tape cassettes respectively holding print tapes 71 of different widths are prepared for the tape cassette 70.

Figure 6:
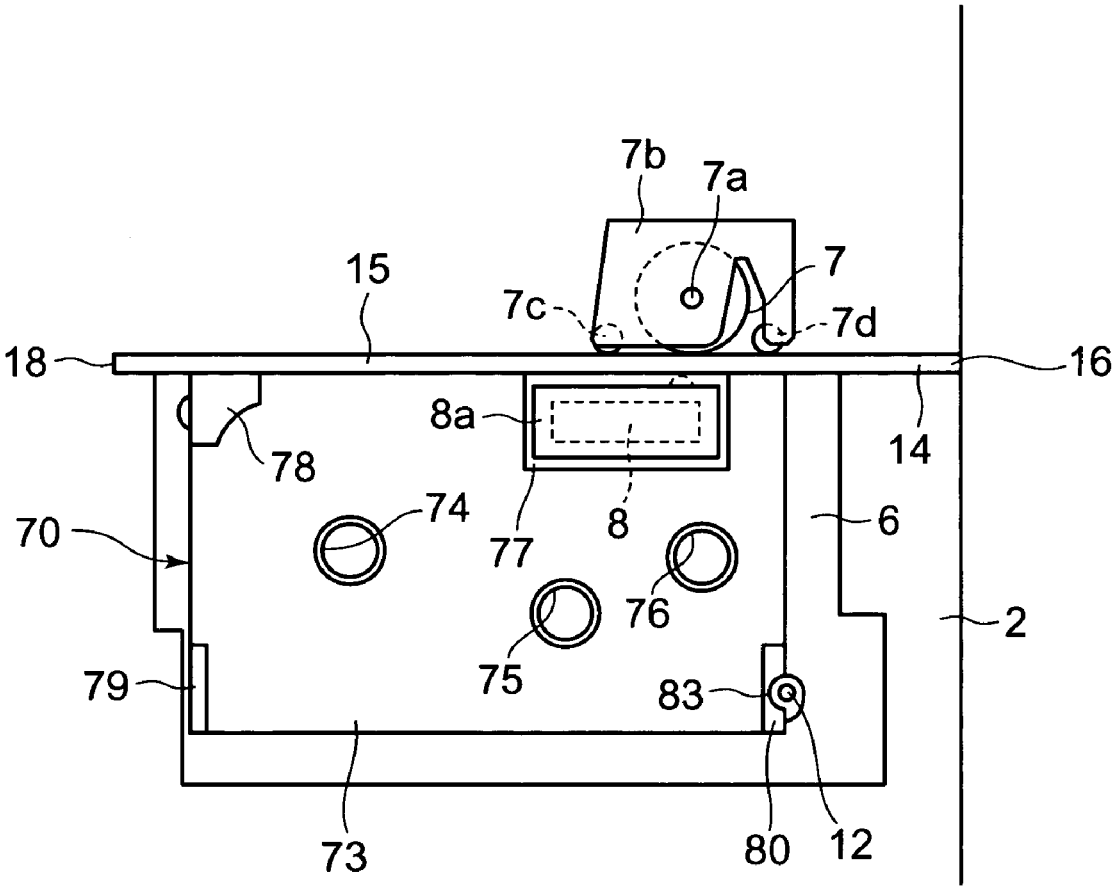
FIG. 6 is a plan view showing a tape cassette received in the receiving section of the printing apparatus.
Figure 7:
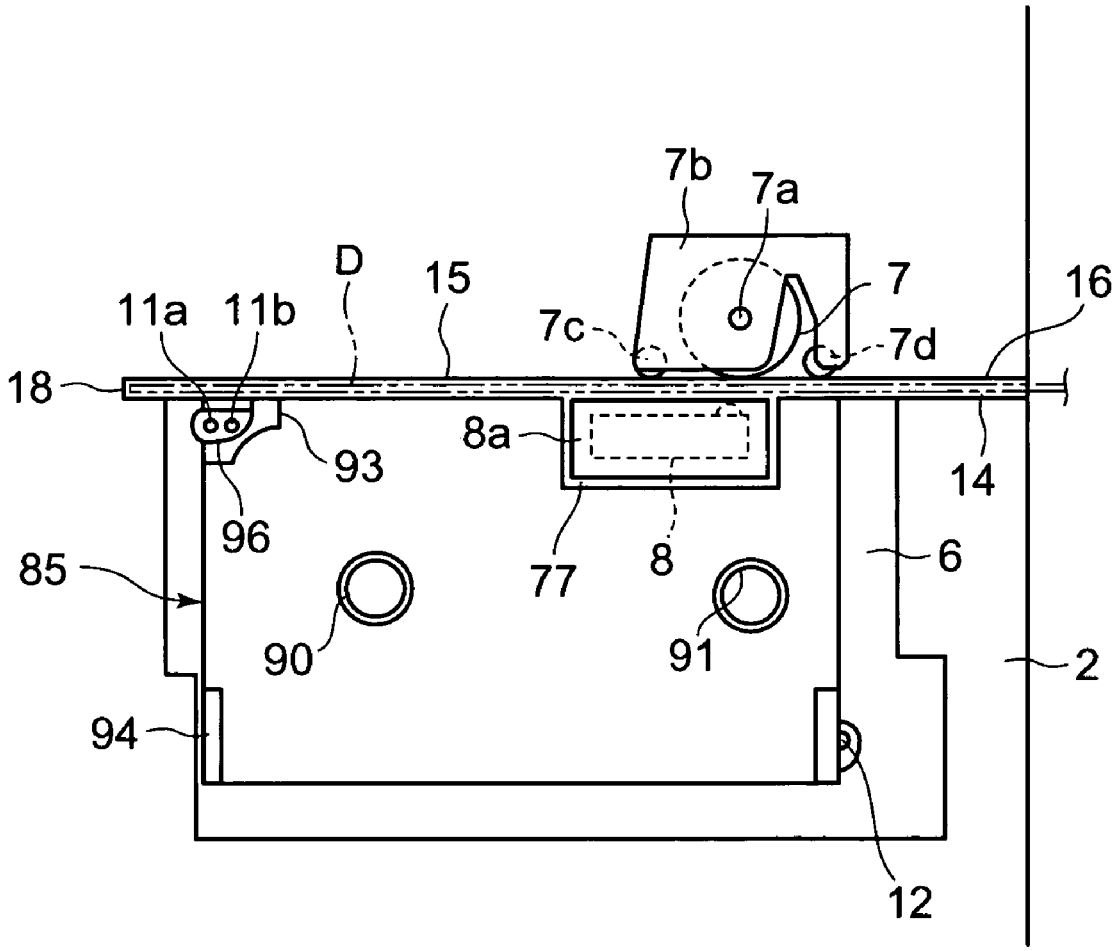
FIG. 7 is a plan view showing a ribbon cassette received in the receiving section of the printing apparatus.

In printing on the print tape, the tape cassette 70 is received in the receiving section 6 as shown in FIG. 6. In printing on a recording medium (optical disk D) or a hard medium, the ribbon cassette 85 and an optical disk D are received in the receiving section 6 as shown in FIG. 7. To retain the optical disk D in the receiving section 6, the optical disk D is set upright, with a label side A to be a print side facing the front side of the main body 1, and a data recording side B opposite to the label side A facing the rear side of the main body 1, as shown by a chain line in FIG. 8, and the upright optical disk D is inserted in a direction indicated by an arrow C from outside the main body 1, and is placed at a position in the main body 1 indicated by a solid line in FIG. 8. A detailed description will be given later on how to receive an optical disk D in the main body 1.

As shown in FIGS. 2 and 3, the receiving section 6 is provided with a platen roller 7, a print head (thermal head) 8 and a ribbon take-up shaft 9. The platen roller 7 is rotatably attached to a mount frame 7*b* with its rotary shaft 7*a* facing perpendicularly, and is rotated by an unillustrated printing motor.

When the tape cassette 70 is received in the receiving section 6, the platen roller 7 feeds the print tape 71 and the ink ribbon 72, held in the tape cassette 70, while sandwiching the print tape 71 and the ink ribbon 72 with the thermal head 8. When the ribbon cassette 85 and the optical disk D are received in the receiving section 6, the platen roller 7 feeds an ink ribbon 87 and the optical disk D while sandwiching the ink ribbon 87 and the optical disk D with the thermal head 8.

Auxiliary rollers 7*c* and 7*d*, located near both respective sides of the platen roller 7 to feed the optical disk D along a predetermined feed passage, are rotatably provided on the mount frame 7*b*. At the time the optical disk D is fed, the three rollers, the platen roller 7 and the auxiliary rollers 7*c* and 7*d*, abut on the optical disk D to linearly feed the optical disk D along the predetermined feed passage. The upstream auxiliary roller 7*c* may be omitted, leaving the downstream auxiliary roller 7*d* alone, so that the optical disk D is supported by the two rollers, the platen roller 7 and the auxiliary roller 7*d*.

The thermal head 8 is provided rotatable in a head cover 8*a*, and is laid out facing the platen roller 7. The thermal head 8 thermally transfers the ink of the ink ribbon 72 on the print tape 71 when the tape cassette 70 is received in the receiving section 6, and thermally transfers the ink of the ink ribbon 87 on the optical disk D when the ribbon cassette 85 is received in the receiving section 6.

The thermal head 8 has a row of heat generating elements laid out perpendicular to the widthwise direction to the print tape 71 and the ink ribbon 72, 87. The heat generating elements are selectively driven and heated based on print data. The ribbon take-up shaft takes up the ink ribbon 72 of the tape cassette 70, and the ink ribbon 87 of the ribbon cassette 85, both used in printing, in the respective cassette cases 73 and 88.

The receiving section 6 is provided with a plurality of supports 10*a*, 10*b* and 10*c* and an engagement portion 10*e*, which engage with the tape cassette 70 and the ribbon cassette 85 to support them at a predetermined position. The receiving section 6 is provided with a plurality of tape cassette detection switches 11*a* and 11*b* for discriminating whether or not the tape cassette 70 is received in the receiving section 6 and discriminating the widthwise size of the tape. The receiving section 6 is also provided with an ink ribbon cassette detection switch 12 for detecting if the ink ribbon cassette 85 is in the receiving section 6. The receiving section 6 is further provided with a disk detection sensor 13 which indicates that the optical disk D is received at a predetermined position and the print start position for the optical disk D.

Figure 10A:
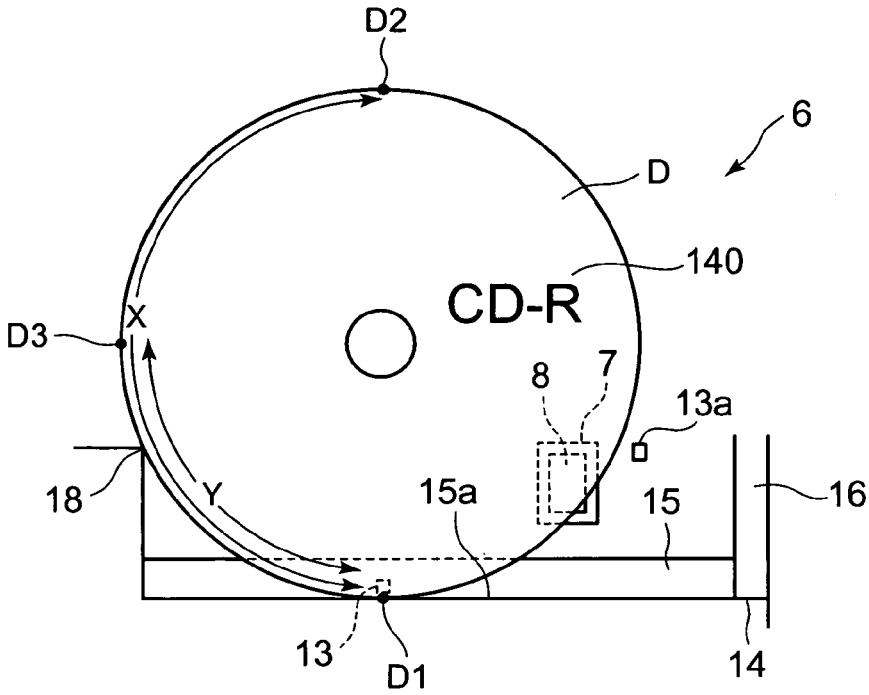
FIG. 10A is an explanatory diagram illustrating an optical disk received at the initial reception position in the receiving section of the printing apparatus.
Figure 10B:
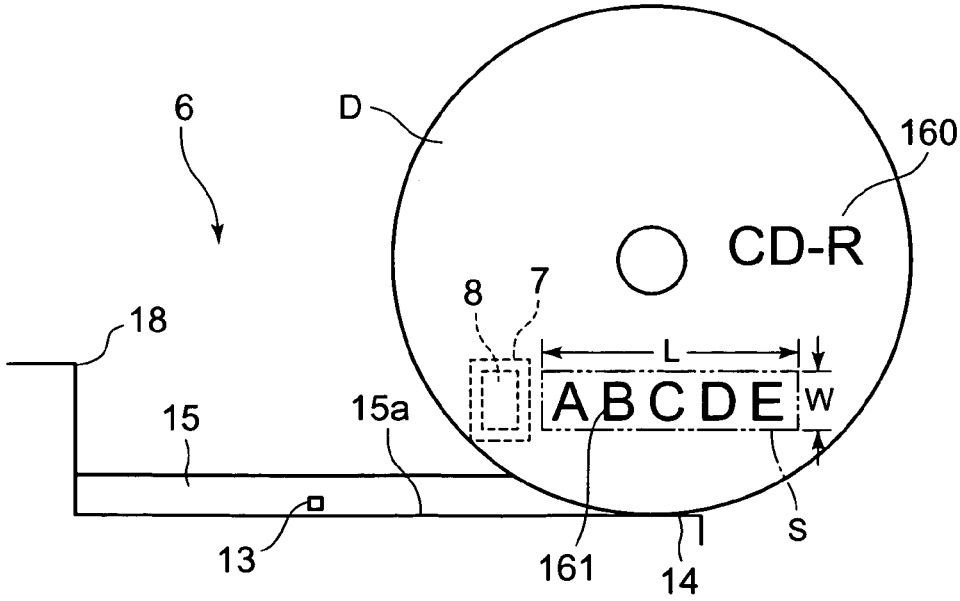
FIG. 10B is an explanatory diagram illustrating a state where printing on an optical disk is finished by the printing apparatus.

A guide section 15 is provided at the inner bottom portion of the receiving section 6. The guide section 15 guides the optical disk D, which is received upright in the receiving section 6 and is fed with its lower end abutting on the guide section 15 while being held between the platen roller 7 and the thermal head 8. As shown in FIGS. 10A and 10B, the guide section 15 is formed into a groove-like shape having a flat guide surface 15*a* at the bottom of the receiving section 6, and extends linearly horizontally from inside the main body 1 so as to communicate with the outside. The optical disk D, which is fed horizontally while being held between the platen roller 7 and the thermal head 8, is guided along the guide section 15 with its lower end abutting on the guide surface 15*a*.

The guide section 15 defines the feed passage for the optical disk D. The interior of the main body 1 is at the upstream of the feed passage, and the exterior of the main body 1 is at the downstream. The platen roller 7 and the thermal head 8 are arranged at a predetermined position in the lengthwise direction of the guide section 15 in such a way as to face each other with the guide section 15 in between. The position is a print position where printing is done on the print tape 71 or the optical disk D. A part of the guide section 15, which is on the downstream side of the feed passage for the optical disk D to near the print position, also serves as a feed passage for the print tape 71.

The end portion of the guide section 15 which faces outside the main body 1 is an opening 16 open to the side portion of the body case 2 of the main body 1. The opening 16 serves as a discharge port to discharge the print tape 71, subjected to printing in the main body 1, outside the main body 1. The opening 16 also serves as an insertion portion to insert the optical disk D into the main body 1, as will be described later.

As shown in FIG. 3, a cutting mechanism 17 for cutting the printed portion of the printed print tape 71 at the distal end is provided at the body case 2 of the main body 1 in the vicinity of the opening 16. The cutting mechanism 17 has a fixed blade 17*a* and a movable blade 17*b*, which are provided so as to face each other with the feed passage for the print tape 71 in between. The fixed blade 17*a* is fixed inside the body case 2, and the movable blade 17*b* is provided movable in the direction away from the fixed blade 17*a*.

When printing on the print tape 71 held in the tape cassette 70 is done, the movable blade 17*b* is driven by a cutter motor to move toward the fixed blade 17*a*. The movement causes the print tape 71 to be held between the fixed blade 17*a* and the movable blade 17*b* and cut. After cutting, the movable blade 17*b* moves away from the fixed blade 17*a* and stops at a standby position.

Provided at the upstream end of the guide section 15 provided in the main body 1 is a positioning portion 18 which abuts on the insertion-side peripheral portion of the optical disk D inserted through the opening 16 at the downstream end and received in the main body 1 to position the optical disk D at the initial reception position, as shown in FIG. 10A.

The disk detection sensor 13 which detects that the optical disk D is received in the receiving section 6 at the initial reception position is a transparent optical sensor having a light emitting portion and a light receiving portion. The light emitting portion and the light receiving portion are provided facing each other in the groove of the guide section 15. As shown in FIG. 10A, the disk detection sensor 13 is located at such a position at which the lowermost end of the optical disk D comes close when the optical disk D is placed upright at the predetermined initial reception position in the receiving section 6.

As shown in FIG. 10A, given that with the optical disk D placed upright at the predetermined initial reception position in the receiving section 6, D1 is the position of the peripheral edge of the optical disk D vertically directly underlying the center of the optical disk D, D2 is likewise the vertically directly overhead position, and D3 is the horizontal downstream end portion of the peripheral edge of the optical disk D through the center of the optical disk D, the layout position of the disk detection sensor 13 may be any position in the printing apparatus P which corresponds to the lower-half peripheral edge of the optical disk D from the position D1 (vicinity inclusive) to the position D2 (vicinity inclusive) and the position D2 (the range indicated by the letter "X" in FIG. 10A). The printing apparatus P is so constructed as to receive the lower half of the upright optical disk D in the receiving section 6 with the disk's upper half exposed to outside the main body 1. It is therefore preferable that the layout position of the disk detection sensor 13 substantially correspond to the peripheral edge of the optical disk D from the position D1 to the position D3 (the range indicated by the letter "Y" in FIG. 10A) shown in FIG. 10A.

As the disk detection sensor 13 is located near the peripheral edge of the optical disk D at the downstream side in the feed direction including the position directly underlying the center of the optical disk D at the initial reception position, it is possible to surely detect the presence of the optical disk D placed at the initial reception position. At the predetermined layout position of the disk detection sensor 13, the transition from the presence of the optical disk D to the absence thereof can be accurately detected when the optical disk D is fed downstream at the time of printing. When feeding the optical disk D starts upon initiation of printing, therefore, the disk detection sensor 13 can detect the movement of the optical disk D so that printing by the thermal head 8 can be started based on the detected information. In this manner, the disk detection sensor 13 can acquire information on the presence or absence of the optical disk D at the initial reception position and information on the positioning of the optical disk D at the print start position.

The receiving-section cover 5 provided on the receiving section 6 is rotatably supported on the top surface of the body case 2 by a hinge. The receiving-section cover 5 is provided with transparent windows 20 and 21 at positions corresponding to the positions of the display section 4 and the receiving section 6. Cassette pressers 22*a*, 22*b* and 22*c* are provided at the bottom of the receiving-section cover 5. The cassette pressers 22*a*, 22*b* and 22*c* abut on the top surfaces of the tape cassette 70 and the ribbon cassette 85 received in the in the receiving section 6 and restrict the vertical positions of the cassettes.

A slit-like ejection port (disk ejection port) 23 extending linearly to one side (right side) of the body case 2 (main body 1) from the center portion of the receiving-section cover 5 is formed in the receiving-section cover 5. With the receiving-section cover 5 closed, the ejection port 23 faces the receiving-section cover 5 vertically, and one side of the ejection port 23 on one side of main body 1 communicates with the opening 16, and both the ejection port 23 and the opening 16 are open to outside at the side portion of the main body 1.

When the upright optical disk D is inserted through the opening 16 and is moved horizontally, the optical disk D moves upstream in the feed direction along the receiving-section cover 5 and the ejection port 23 and reaches the initial reception position in the receiving section 6. At this time, nearly the upper half of the optical disk D protrudes outside the printing apparatus P from the ejection port 23.

At the time of printing, the optical disk D is fed downstream along the receiving-section cover 5 and the ejection port 23 during which printing on the optical disk D is done. After printing, the optical disk D is placed at an ejection portion 14 at the downstream end portion of the receiving-section cover 5, as shown in FIG. 10B, so that the optical disk D placed at the ejection portion 14 can be pulled up through the ejection port 23 out of the main body 1. The area indicated by the letter "S" in FIG. 10B is a print area at a part of the lower half portion of the optical disk D on which printing is done in the printing operation. The print area S has a width (height) W and a length L. The width W corresponds to the size of the row of heat generating elements of the thermal head 8, and the length L to the relatively moving distance of the thermal head 8 to the optical disk D at the time of printing. A sequence of characters "CD-R" shown in FIGS. 10A and 10B by reference numeral "160" is pre-printed on the label side of the optical disk D, and a sequence of characters "ABCDE" shown in FIG. 10B by reference numeral "161" is what is printed by the printing apparatus P.

Printing is done as the optical disk D is fed downstream from the upstream side along the guide section 15. When printing ends, the optical disk D is fed to the position of the ejection portion 14 and stops with its downstream-side portion in the feed direction sticking out the main body 1. The optical disk D has the weight balanced at the right and left to the vertical center line. A half or greater portion of the optical disk D at the upstream side in the feed direction, which has been fed to the ejection portion 14 and is stopped there at the end of printing, is supported on the ejection portion 14. That is, the optical disk D is supported on the ejection portion 14 while the barycenter of the optical disk D, which is at the center in the feed direction and at the center of the optical disk D, directly overlies the ejection portion 14 or is positioned little inward of the main body 1 from the directly overlying position. This facilitates ejection of the optical disk D out of the apparatus after printing, and prevents the weight of the optical disk D from being off balanced and from falling out from the ejection portion 14. Particularly, the optical disk D has a circular shape, and, what is more, printing is done with the optical disk D upright. Therefore, the optical disk D after printing may fall out of the apparatus and roll upright unless the optical disk D is carefully handled. However, the feeding of the optical disk D after printing in the aforementioned manner can reliably avoid such an inconvenience and surely hold the optical disk D on the main body 1.

Figure 11:
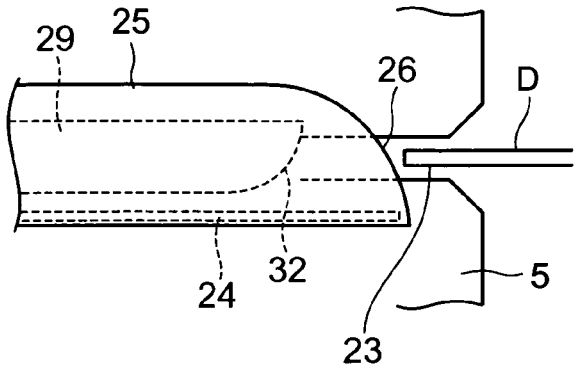
FIG. 11 is an explanatory diagram showing an ejection-port cover and an insertion-prevention member of the printing apparatus as seen from the plan view.
Figure 12:
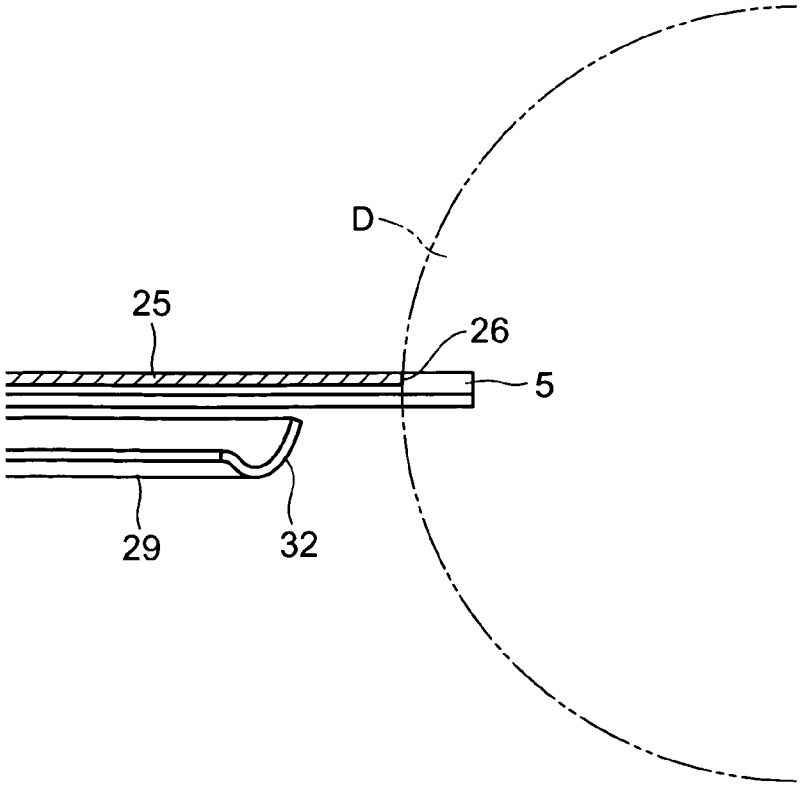
FIG. 12 is an explanatory diagram showing the ejection-port cover and the insertion-prevention member of the printing apparatus as seen from the side.

An elongated plate-like ejection cover 25 extending in the lengthwise direction of the ejection port 23 is provided on the receiving-section cover 5 to prevent dust from entering the ejection port 23. As shown in FIGS. 11 and 12, one side edge of the ejection cover 25 on the key input section (3) side along the lengthwise direction of the ejection port 23 (fore and front side of the main body 1) is rotatably attached to the receiving-section cover 5 via a shaft 24, and the ejection cover 25 is normally folded down by the dead weight, covering the ejection port 23. Although not illustrated, a magnet is provided at one portion of the free end side of the ejection cover 25 at the back side thereof, and a metal piece is provided at the corresponding position of the edge portion of the ejection port 23 of the receiving-section cover 5, so that the magnetic force of the magnet prevents the ejection cover 25 from being opened unintentionally.

Figure 8:
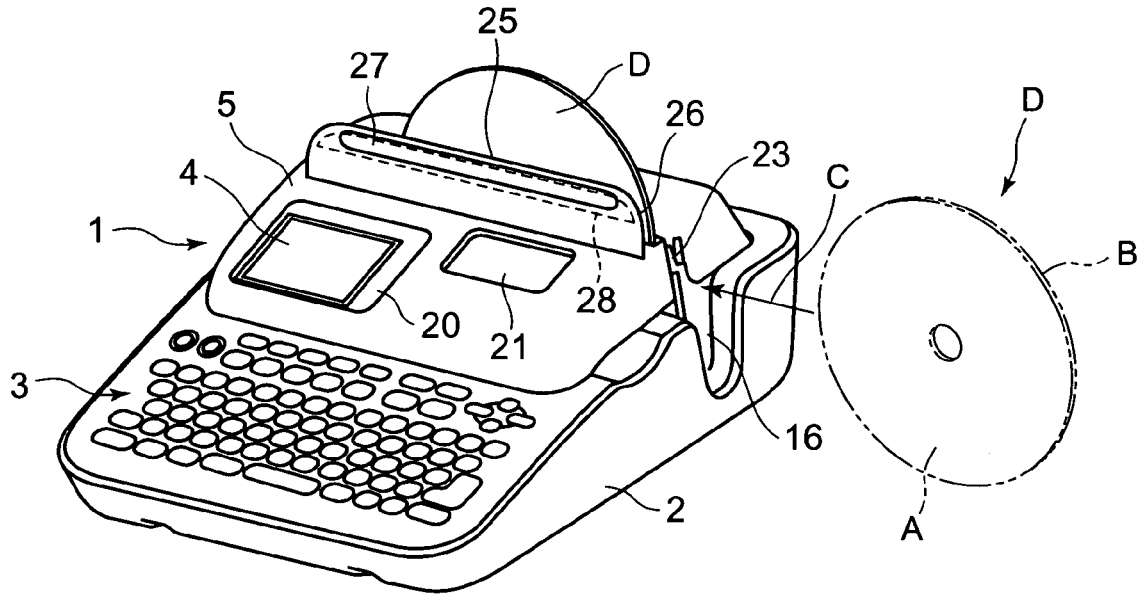
FIG. 8 is a perspective view showing an optical disk received in the receiving section of the printing apparatus.
Figure 9A:
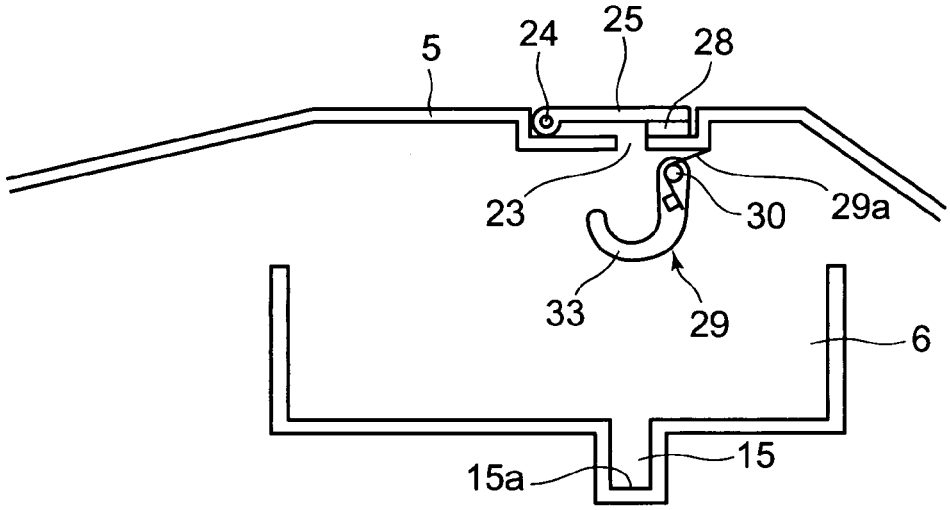
FIG. 9A is a cross-sectional view of the receiving section of the printing apparatus.
Figure 9B:
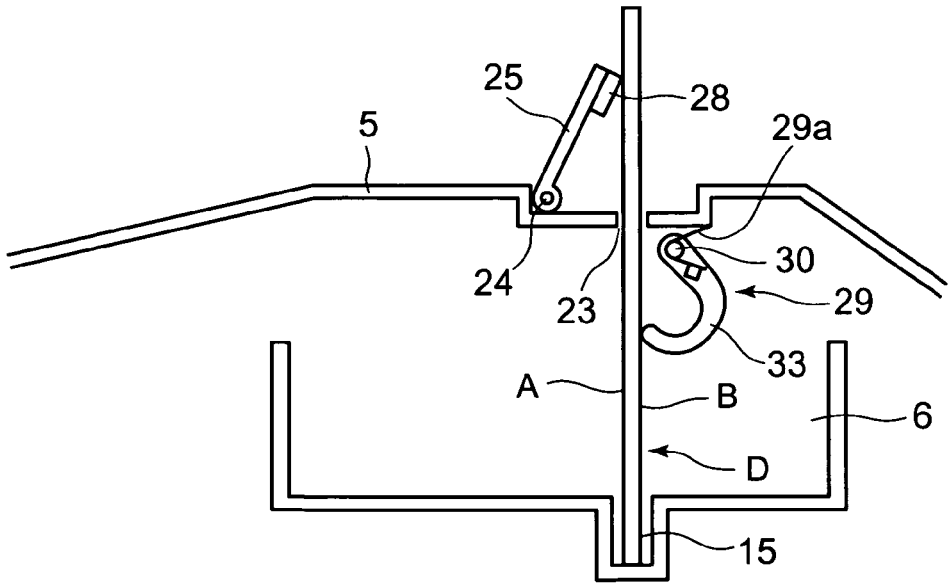
FIG. 9B is a cross-sectional view showing an optical disk received in the receiving section of the printing apparatus.

The end portion of the ejection cover 25 which faces the opening 16 serves as an inclined portion 26 inclined toward the free end side of the ejection cover 25 from the shaft 24 with respect to the direction orthogonal to the shaft 24 in a plan view, as shown in FIG. 11. As the optical disk D is inserted upright through the opening 16 along the guide section 15, as shown in FIG. 12, the outer edge of the upper half of the optical disk D on the insertion-end side (the leading side in the moving side at the time of insertion) abuts on the inclined portion 26 with the lower end portion of the optical disk D abutting on the guide surface 15*a* at the bottom of the guide section 15. When the optical disk D is inserted upright through the opening 16 along the guide section 15, therefore, the insertion-side end portion of the upper half of the optical disk D abuts on the inclined portion 26, as shown in FIG. 12. The abutment presses the ejection cover 25 against the optical disk D and turns the ejection cover 25 upward about the shaft 24, facing the key input section 3 on the front side of the printing apparatus P in such a way as to cover the label side A of the optical disk D and standing upright as shown in FIGS. 8 and 9B.

The ejection cover 25 is formed of a transparent material, so that the label side A of the optical disk D can be seen when the optical disk D placed upright with the label side A facing the fore and front side of the printing apparatus P is received in the main body 1 and the ejection cover 25 stands upright covering the label side A of the optical disk D at the fore side of the label side A. A bar-like positioning mark 27 colored by a predetermined color is provided at the ejection cover 25 of a transparent material in the lengthwise direction as shown in FIG. 8.

With the optical disk D received at the initial reception position in the receiving section 6, as the optical disk D is rolled at the initial reception position and its position is adjusted in such a way that the pre-printed portion, such as a maker name or a product name like "CD-R", pre-printed on the label side A of the optical disk D, becomes in parallel to the positioning mark 27. Accordingly, the direction of the sequence of characters to be printed by the printing apparatus P can be positioned in parallel to the pre-printed portion.

While the material for the ejection cover 25 is preferably a transparent material, it may be an opaque material. The positioning mark 27 is not limited to the illustrated bar-like shape as long as it can position the direction of the sequence of characters to be printed by the printing apparatus P in parallel to the pre-printed portion.

A buffer member 28 is provided at the back side of the ejection cover 25 in the lengthwise direction. As the optical disk D is inserted through the opening 16 with the label side A facing the fore and front side of the main body 1, the label side A of the optical disk D slides on the back side of the ejection cover 25. The buffer member 28 provided at the back side of the ejection cover 25 can however protect the label side A of the optical disk D.

The receiving-section cover 5 is provided with an insertion-prevention member 29 as an insertion-prevention section to prevent the optical disk D from being erroneously inserted in the receiving section 6 through the ejection port 23 from above. The insertion-prevention member 29 is provided rotatably at the receiving-section cover 5 below the ejection port 23 by a shaft 30 provided in parallel to the shaft 24. The insertion-prevention member 29 is elastically urged by a spring member 29*a* so as to rotate to face the ejection port 23, so that the insertion-prevention member 29 is normally so held as to face the ejection port 23 below the ejection port 23.

The insertion-prevention member 29 is provided in the lengthwise direction of the ejection port 23, and its end portion facing the opening 16 serves as an inclined surface 32 inclined from the shaft 30 side toward the opposite free end side in a plan view as shown in FIG. 11. As shown in FIG. 12, when the optical disk D is inserted upright along the guide section 15, the insertion-side lower-half outer edge of the optical disk D abuts on the inclined surface 32 while the lower end portion of the optical disk D abuts on the guide surface 15*a* at the bottom of the guide section 15.

When the optical disk D is inserted through the opening 16, as shown in FIG. 12, the insertion-side end of the lower half of the optical disk D abuts on the inclined surface 32 of the insertion-prevention member 29. Accordingly, the insertion-prevention member 29 rotates downward about the shaft 36, opening the underside of the ejection port 23. This can allow for the insertion of the optical disk D.

The insertion-prevention member 29 has a cross section nearly shaped like the shape of the English letter "J". The upper end portion of the insertion-prevention member 29 is rotatably supported on the receiving-section cover 5. A portion of the upper end portion extending downward from the upper end is a stop portion 32 curved in an arcuate shape. The stop portion 32 normally faces the ejection port 23 at a position in the main body 1 directly below the ejection port 23.

When the optical disk D is erroneously inserted through the ejection port 23 from above, the insertion-prevention member 29 is pressed by the optical disk D and is rolled slightly, but the optical disk D is stopped by the stop portion 32 and is inhibited from being further inserted into the main body 1.

In the printing apparatus P, the platen roller 7 and the thermal head 8 are provided upright in the receiving section 6 in such a way as to face the guide section 15. When the ribbon cassette 85 is received in the receiving section 6 and printing is to be done on the optical disk D, the ink ribbon 87 of the ribbon cassette 85 is fed horizontally downward from the upstream of the guide section 15 with the widthwise direction of the ink ribbon 87 facing vertically.

When the optical disk D is inserted upright in the receiving section 6 through the opening 16 along the guide section 15, the ink side of the ink ribbon 87 faces the label side (print side) A of the optical disk D, and the feed direction of the ink ribbon 87 (ribbon feed direction) becomes in parallel to the insertion direction of the optical disk D. Therefore, the ink ribbon 87 is unlikely to be caught by the optical disk D at the time the optical disk D is inserted in the main body 1. In other words, the optical disk D is inserted in the main body 1 in the direction parallel to the feed direction of the ink ribbon 87, so that disk insertion is carried out smoothly without twisting or damaging the ink ribbon 87.

If the optical disk D is inserted upright in the receiving section 6 through the ejection port 23, the ink side of the ink ribbon 87 faces the label side A of the optical disk D, and the feed direction of the ink ribbon 87 (ribbon feed direction) becomes orthogonal to the insertion direction of the optical disk D. With the ribbon feed direction orthogonal to the insertion direction of the optical disk D, the ink ribbon 87 may be caught and damaged by the optical disk D when the optical disk D is inserted in the main body 1. As a solution to the probable trouble, the insertion-prevention member 29 is provided in association with the ejection port 23 in the printing apparatus P, thus preventing the insertion of the optical disk D from the direction orthogonal to the feed direction (ribbon feed direction) of the ink ribbon through the ejection port 23.

The tape cassette 70 and the ribbon cassette 85 to be received in the receiving section 6 will be explained more specifically referring to FIGS. 4 and 5.

As shown in FIGS. 4A and 4B, the tape cassette 70 has the cassette case 73. The cassette case 73 accommodates a tape core 74 around which the print tape 71 is wound, a ribbon feed core 75 around which an unused ink ribbon 72 is wound, and a ribbon take-up core 76 which takes up the printed or used portion of the ink ribbon 72.

The cassette case 73 is provided with a head insertion portion 77 through which the thermal head 8 is inserted and which is formed by shaping a part of the outer wall of the cassette case 73 in a recess shape. The print tape 71 and the ink ribbon 72 are fed out from inside the cassette case 73 into the head insertion portion 77. The ink ribbon 72 used in printing is taken up around the ribbon take-up core 76, and is circulated inside the cassette case 73.

To-be-supported portions 78, 79 and 80 corresponding to the supports 10*a*, 10*b* and 10*c* of the receiving section 6 are provided at the corner portions of the cassette case 73. Cutaway portions 81 and 82, indicated by broken lines in FIG. 4A, are provided at the to-be-supported portion 78 in association with the tape cassette detection switches 11*a* and 11*b* and in accordance with the types of the cassettes to set the tape cassette detection switches 11*a* and 11*b* on and off. There are three cassette types: either one of the cutaway portions 81 and 82 provided and no cutaway portion provided. The to-be-supported portion 80 is provided with a cutaway portion 83 in association with the ink ribbon cassette detection switch 12.

The print tape 71 held in the tape cassette 70 comprises the lamination of a tape member of PET (Polyethylenetelephthalate) resin having a receptor layer from which ink is transferred onto a top surface to be a print surface, an adhesive applied to the back side of the tape member, and a peel tape whose surface has undergone a peeling treatment. The ink ribbon 72 held in the tape cassette 70 comprises, for example, a base tape to which a resin-based ink containing a mixture of an epoxy resin and polyester resin is applied.

As shown in FIGS. 5A and 5B, the ribbon cassette 85 has the cassette case 88. The cassette case 88 accommodates a ribbon feed core 90 around which an unused ink ribbon 87 is wound, and a ribbon take-up core 91 which takes up the printed or used portion of the ink ribbon 87.

The cassette case 88 is provided with a head insertion portion 92 through which the thermal head 8 is inserted and which is formed by shaping a part of the outer wall of the cassette case 88 in a recess shape. The ink ribbon 87 is fed out from inside the cassette case 88 into the head insertion portion 92. The ink ribbon 87 used in printing is taken up around the ribbon take-up core 91, and is circulated inside the cassette case 88.

To-be-supported portions 93, 94 and 95 corresponding to the supports 10*a*, 10*b* and 10*c* are provided at the cassette case 88. A cutaway portion 96 is provided at the to-be-supported portion 93 in association with the tape cassette detection switches 11*a* and 11*b* to set the switches off. No cutaway portion is provided at the to-be-supported portion 95 corresponding to the ink ribbon cassette detection switch 12, thereby allowing the switch 12 to be set on.

The ink ribbon 87 held in the ribbon cassette 85 comprises, for example, a base tape to which an ink having a resin containing a wax added to a mixture of a urea aldehyde resin and a galvanizing wax is applied.

When the tape cassette 70 is mounted into receiving section 6 of the printing apparatus P with the above-described structure, the thermal head 8 is placed into the head insertion portion 77 of the cassette case 73, and the ribbon take-up shaft 9 is fitted into the ribbon take-up core 76. When the ribbon cassette 85 is mounted into receiving section 6 of the printing apparatus P with the above-described structure, the thermal head 8 is placed into the head insertion portion 92 of the cassette case 88, and the ribbon take-up shaft 9 is fitted into the ribbon take-up core 91.

Next, the printing/feeding mechanism which constitutes the printing section and the feeder will be described referring to FIGS. 13 to 17. The printing/feeding mechanism is provided in the main body 1, and performs various operations, such as movement of the thermal head 8 between the print position and the non-print position, feeding of the print tape 71, the ink ribbons 72 and 87, and the optical disk D, take-up of the ink ribbons 72 and 87, and tensioning of the ink ribbons 72 and 87.

A single printing motor 35 serves as a drive source. Reference numeral "36" denotes an output gear 36 for the printing motor 35. Reference numerals "37" to "40" denote first to fourth reduction gears, Reference numeral "41" denotes a first sun gear, Reference numeral "42" denotes a first planet gear, and Reference numeral "43" denotes a second planet gear. Reference numeral "45" denotes a cam gear having a cam groove 46 and first and second tooth-less portions 47 and 48. The first and second tooth-less portions 47 and 48 do not have teeth at different thicknesswise positions of the peripheral portion thereof.

Figure 18:
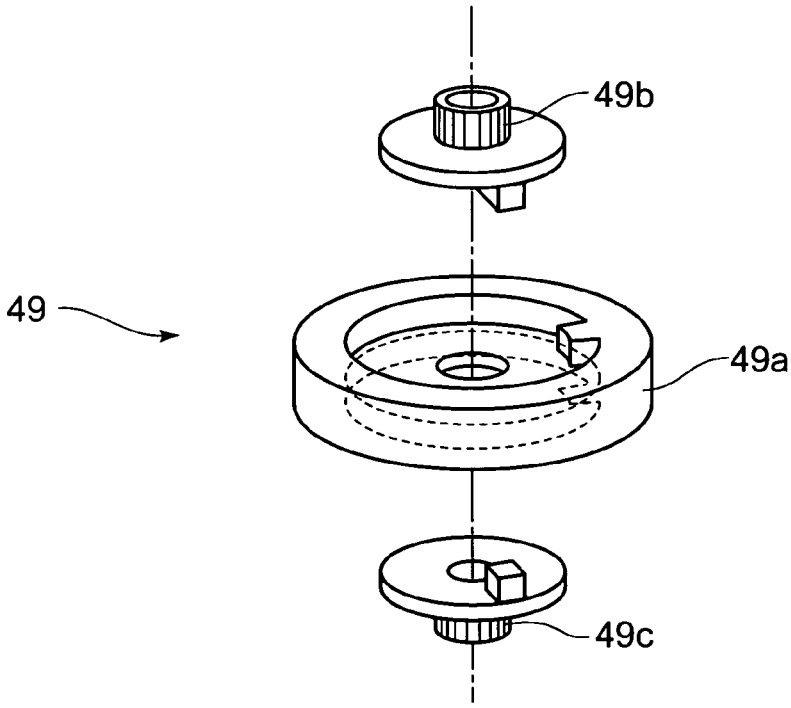
FIG. 18 is a diagram showing the structure of a lag gear mechanism of the printing/feeding mechanism.

A lag gear mechanism 49 has three lag gears 49*a*, 49*b* and 49*c* as shown in FIG. 18, and has a lag function between the gears 49*a* and 49*b* and between the gears 49*a* and 49*c*.

A one-way gear 50 transmits drive power only in one rotational direction. Platen gears 51 and 52 are provided coaxially with the platen roller 7. Reference numeral "53" denotes a second sun gear, Reference numeral "54" denotes a third planet gear, Reference numeral "55" denotes an intermediate gear, Reference numeral "56" denotes a third sun gear, Reference numeral "57" denotes a fourth planet gear, and Reference numeral "58" denotes a ribbon take-up gear 58 provided coaxially with the ribbon take-up shaft 9.

The output gear 36 of the motor 35 engages with the first sun gear 41 via the first to fourth reduction gears 37 to 40 the first planet gear 42 and the second planet gear 43 are laid out around the first sun gear 41, and engage with the first sun gear 41. The first planet gear 42 is positioned at the same level as the first tooth-less portion 47 of the cam gear 45, and the second planet gear 43 is positioned at the same level as the second tooth-less portion 48. The first planet gear 42 and the second planet gear 43 are supported on the first sun gear 41 in such a way as to be engageable with the cam gear 45.

The first sun gear 41 engages with the lag gear 49*a* of the lag gear mechanism 49. One of the lag gears 49*b* and 49*c* which rotate with a delay with respect to the rotation of the lag gear 49*a* engages with the one-way gear 50, and the other one engages with the intermediate gear 55.

The platen gear 51 coaxial with the platen roller 7 engages with the one-way gear 50, and the other platen gear 52 engages with the second sun gear 53. The intermediate gear 55 engages with the third sun gear 56.

The third planet gear 54, which engages with the second sun gear 53, is arranged around the second sun gear 53 in a revolvable manner, ÿ and the fourth planet gear 57, which engages with the third sun gear 56, is arranged around the third sun gear 56 in a revolvable manner. The third planet gear 54 and the fourth planet gear 57 engage with the ribbon take-up gear 58 according to the revolution.

A head arm 59 holds the thermal head 8. The head arm 59 has a pin 60 on the opposite side to the side where the thermal head 8 is mounted. The pin 60 engages with the cam groove 46 of the cam gear 45. The head arm 59 is elastically urged by a tension spring 61 and is rotatable about a shaft 62. The pin 60 slides toward the edge portion of the cam groove 46 in accordance with the rotation of the cam gear 45, causing the head arm 59 to rotate about the shaft 62.

Figure 13:
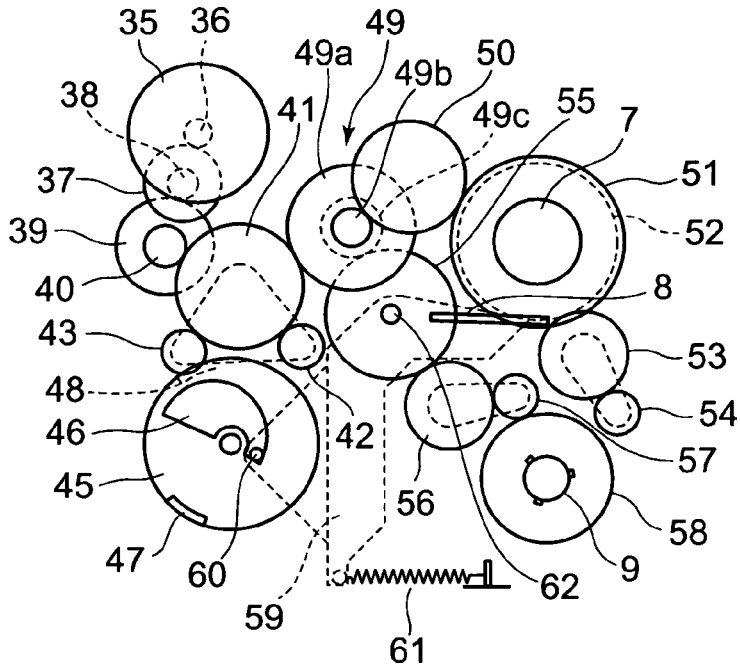
FIG. 13 is a diagram showing the structure of a printing/feeding mechanism of the printing apparatus.

FIG. 13 shows the initial state before printing starts. In this state, as illustrated in the diagram, the thermal head 8 is separated from the platen roller 7.

Figure 14:
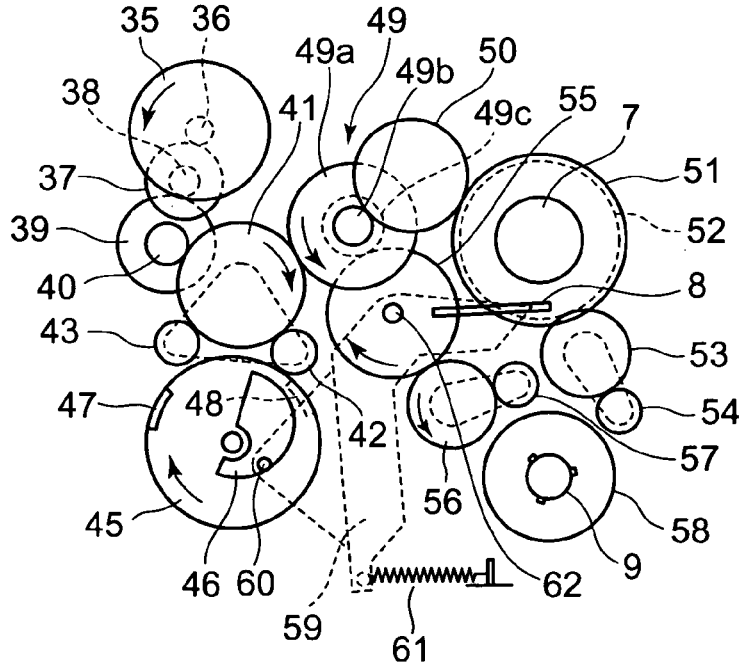
FIG. 14 is a diagram illustrating a state where the first stage of the printing/feeding mechanism is in operation.

FIG. 14 shows a state immediately after the printing motor 35 has started operating in response to a print start instruction. As the printing motor 35 rotates in the forward rotational direction indicated by the arrow in the diagram, the drive power is transmitted to the cam gear 45 via the gears 36 to 40, the first sun gear 41 and the first planet gear 42, rotating the cam gear 45 clockwise. As a result, the pin 60 moves long the edge portion of the cam groove 46, and the elastic force of the tension spring 61 causes the head arm 59 to rotate counterclockwise about the shaft 62, moving the thermal head 8 toward the platen roller 7.

The drive power of the printing motor 35 is transmitted to the lag gear 49*a* via the gears 36 to 40, and the first sun gear 41. Because of the lag function between the lag gear mechanism 49 and the lag gear 49*b*, however, the lag gear 49*b* does not rotate. Because the lag gear 49*b*, which is in engagement with the platen gear 51 via the one-way gear 50, does not rotate, the drive power is not transmitted to the platen roller 7.

At this time, no lag function works between the lag gear 49*a* and the lag gear 49*c*, so that the drive power of the first sun gear 41 is transmitted to the third sun gear 56 via the intermediate gear 55. Because the fourth planet gear 57 is disengaged from the ribbon take-up gear 58, however, the ribbon take-up shaft 9 is not driven. While the thermal head 8 is moving to the print position, therefore, neither the platen roller 7 nor the ribbon take-up shaft 9 is driven.

Figure 15:
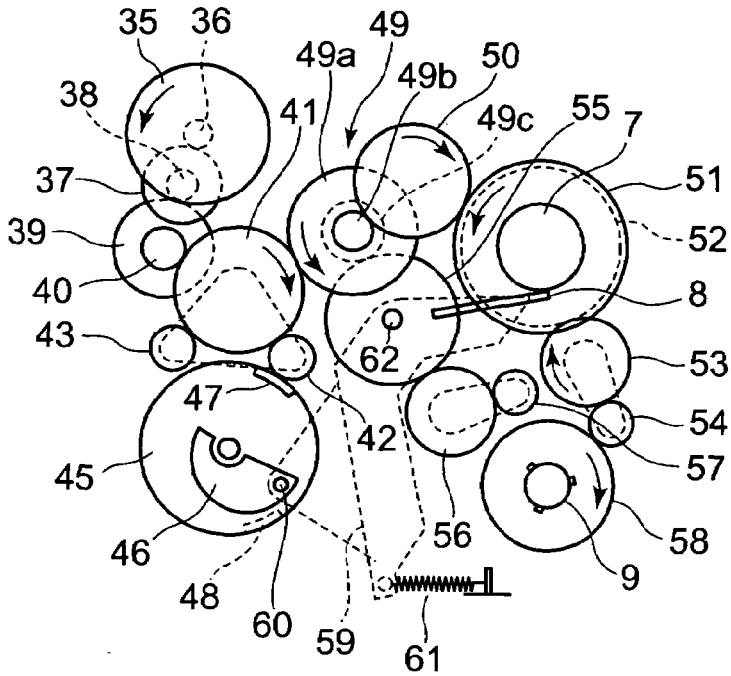
FIG. 15 is a diagram illustrating a state where the second stage of the printing/feeding mechanism is in operation.

FIG. 15 shows a state (head-down state) where the pressure of the thermal head 8 on the platen roller 7 is completed and the thermal head 8 is moved to the print position. Printing starts in this state. At this time, as illustrated in the diagram, the rotation of the cam gear 45 causes the first planet gear 42 to drop in the first tooth-less portion 47 of the cam gear 45. This disconnects the transmission of the drive power of the printing motor 35 to the cam gear 45, stopping the rotation of the cam gear 45, so that the thermal head 8 is held pressed against the platen roller 7.

At this time, the period of lagging between the lag gear 49*a* and the lag gear 49*b* ends, and the drive power of the printing motor 35 is transmitted to the platen gear 51 via the one-way gear 50, so that the platen roller 7 is driven. Further, the second sun gear 53 and the third planet gear 54 are driven via the platen gear 52, the third planet gear 54 engages with the ribbon take-up gear 58, permitting the transmission of the drive power, rotating the ribbon take-up shaft 9.

Figure 16:
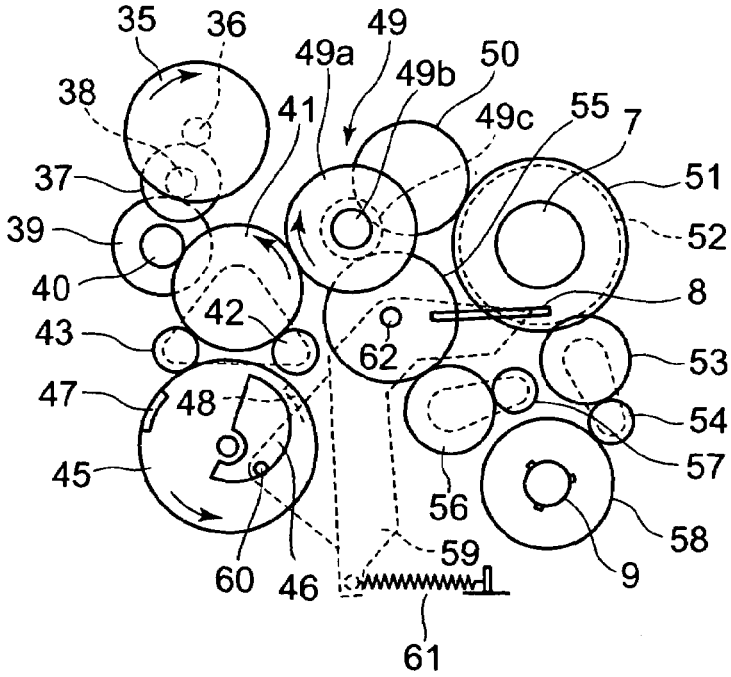
FIG. 16 is a diagram illustrating a state where the third stage of the printing/feeding mechanism is in operation.

FIG. 16 shows a state (head-up state) where printing is done, and the thermal head 8 is separated from the platen roller 7 and is moved to the non-print position. When printing is done, the printing motor 35 is driven reversely. As a result, the first sun gear 41 rotates counterclockwise, so that the first planet gear 42 disengages from the first tooth-less portion 47, and the second planet gear 43 engages with the cam gear 45. The engagement causes the drive power of the printing motor 35 to be transmitted to the cam gear 45, causing the cam gear 45 to rotate counterclockwise from the state in FIG. 15. The rotation of the cam gear 45 causes the head arm 59 to rotate clockwise, separating the thermal head 8 from the platen roller 7.

The one-way gear 50 rotates clockwise when the printing motor 35 rotates in the forward direction to transmit the drive power of the printing motor 35 to the platen gear 51. When the printing motor 35 rotates in the reverse direction, however, the one-way gear 50 blocks the transmission of the drive power so that the platen roller 7 does not rotate.

At this time, the lag gear 49*a* of the lag gear mechanism 49 rotates in response to the rotation of the first sun gear 41, but the lag function between the lag gear 49*a* and the lag gear 49*c* prevents the intermediate gear 55 and the third sun gear 56 from rotating. This disengages the fourth planet gear 57 from the ribbon take-up gear 58, inhibiting the transmission of the drive power to the ribbon take-up shaft 9.

Figure 17:
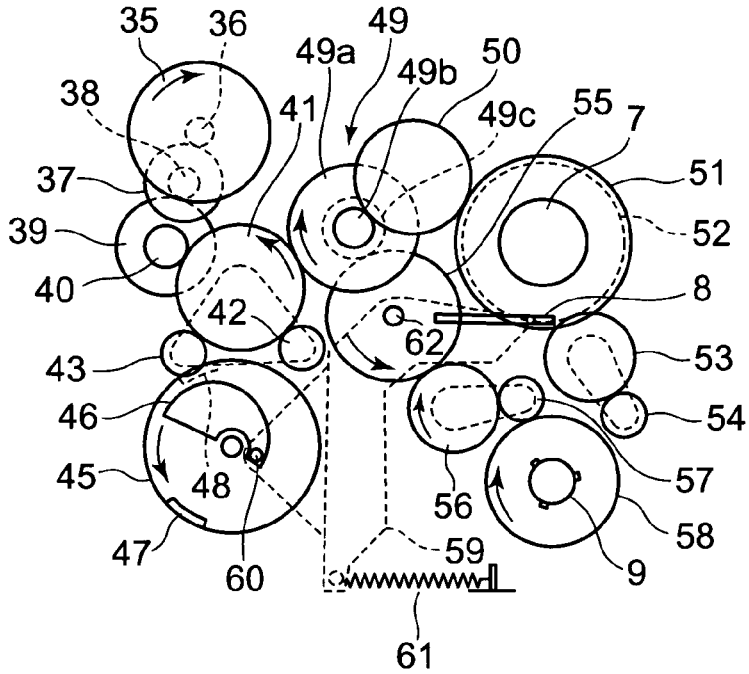
FIG. 17 is a diagram illustrating a state where the fourth stage of the printing/feeding mechanism is in operation.

FIG. 17 illustrates a process of tensioning the ink ribbon which is executed after the head-up state where the thermal head 8 is separated from the platen roller 7.

After the thermal head 8 is separated from the platen roller 7, the cam gear 45 further rotates counterclockwise, causing the second planet gear 43 to drop in the second tooth-less portion 48 of the cam gear 45. This stops the rotation of the cam gear 45, so that the thermal head 8 is kept positioned at the non-print position.

At this time, the lag function between the lag gear 49*a* and the lag gear 49*c* is released, causing the drive power to be transmitted to the intermediate gear 55 and the third sun gear 56 from the lag gear 49*a*. As a result, the fourth planet gear 57 engages with the ribbon take-up gear 58, causing the ribbon take-up shaft 9 to be rotated in the take-up direction. Accordingly, the ink ribbon loosened by the separation of the thermal head 8 from the platen roller 7 is taken up, and is tensioned. The tensioning of the ink ribbon is carried out by driving the printing motor 35 reversely only for a predetermined time set according to the head-up operation at the end of printing.

Printing is executed as the single printing motor 35 is driven in this manner and the operations in FIGS. 13 to 17 are repeated.

Figure 19A:
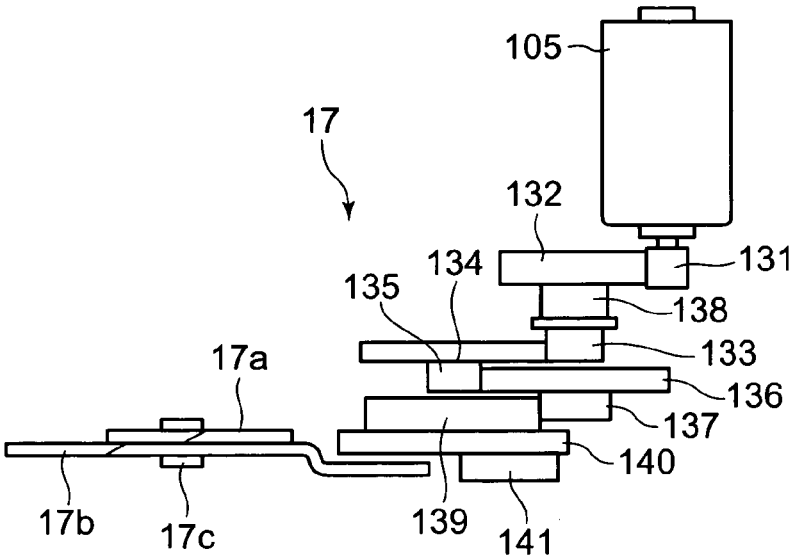
FIG. 19A is a plan view of a cutting mechanism.
Figure 19B:
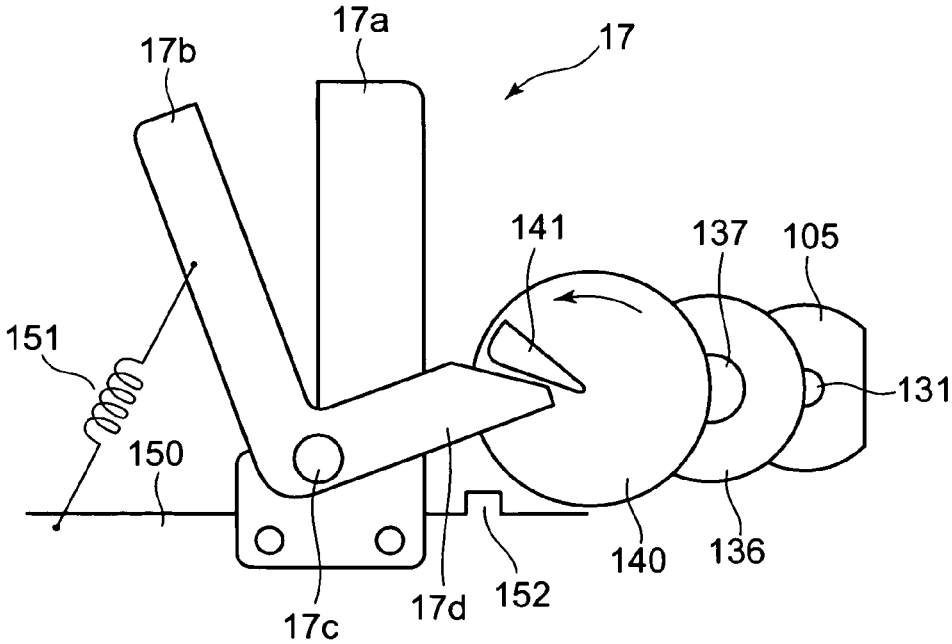
FIG. 19B is a side view of the cutting mechanism.

The structure of the cutting mechanism 17 will be described more specifically referring to FIGS. 19A and 19B. FIG. 19A is a plan view of the cutting mechanism 17, and FIG. 19B is a side view of the cutting mechanism 17. As shown in FIGS. 19A and 19B, the cutting mechanism 17 has the fixed blade 17*a*, fixed to a frame 150 provided in the main body 1, and the movable blade 17*b*. The movable blade 17*b* is rotatably supported on the fixed blade 17*a* by a shaft 17*c*, and is urged by a spring 151 in a direction of being open to the fixed blade 17*a*. The cutting mechanism 17 operates on the drive power of a cutter motor 105. An output gear 131 is provided on the output shaft of the cutter motor 105. The drive power of the cutter motor 105 is transmitted to a cam gear 139 via first to sixth reduction gears 132 to 137, rotating a cam plate 140 having a projection 141 provided integral with the cam gear 139. As the projection 141 of the cam plate 140 presses the end portion of an arm portion 17*d* connected to the lower end portion of the movable blade 17*b*, the movable blade 17*b* rotates toward the fixed blade 17*a*. Reference numeral "138" denotes a clutch provided in the train of the reduction gears. Although not illustrated, there are detection switches which respectively detect that the movable blade 17*b* is at the initial position and the cutting end position.

When the motor 105 rotates in the forward direction, for example, the cam plate 140 rotates counterclockwise, and the movable blade 17*b* rotates toward the fixed blade 17*a* to carry out the cutting operation. When the movable blade 17*b* moves to the position at which the movable blade 17*b* crosses the fixed blade 17*a*, the arm portion 17*d* of the movable blade 17*b* abuts on a stopper portion 152 provided on the frame 150, inhibiting further rotation of the movable blade 17*b*, and the clutch 138 works to absorb the drive power of the cutter motor 105. When the cutter motor 105 is rotated reversely after the cutting operation finishes, the cam plate 140 rotates clockwise, and the movable blade 17*b* moves to the initial position by the action of the tension spring 151.

The cutting mechanism 17 is automatically driven after a tape printing process, which is executed under the control of the controller, is finished, or operates as the user operates the cutter key provided on the key input section 3, as will be described later.

Checking if the optical disk D is received at a predetermined reception position and positioning of the optical disk D at the print start position are both carried out based on information from the single disk detection sensor 13 provided in the center portion of the guide section 15. However, two sensors may respectively carry out those two functions. A proximity sensor 13*a* is additionally provided near and downstream of the platen roller 7 and the thermal head 8, as shown in FIG. 10A. In this case, the disk detection sensor 13 has a function of checking if the optical disk D is received at the predetermined reception position, while the sensor 13*a* has a function of positioning of the optical disk D at the print start position. The sensor 13*a* is positioned near and downstream of the peripheral edge of the optical disk D received at the initial reception position, as shown in FIG. 10A. The sensor 13*a* may comprise a reflective optical sensor. In the state in FIG. 10A, the output of the disk detection sensor 13 is at a low level. So is the output of the sensor 13*a*. The reception of the optical disk D at the initial reception position is determined based on the combination of those pieces of information. When printing starts and the optical disk D is fed downstream, the optical disk D is no longer located at the position of the disk detection sensor 13, making the output of that sensor 13 at a high level. As the optical disk D comes to the position of the sensor 13*a*, however, the output of the sensor 13*a* becomes a high level when the periphery edge of the optical disk D reaches the position. Based on the information from the two sensors, it is possible to control the timing of starting printing on the optical disk D.

Figure 20:
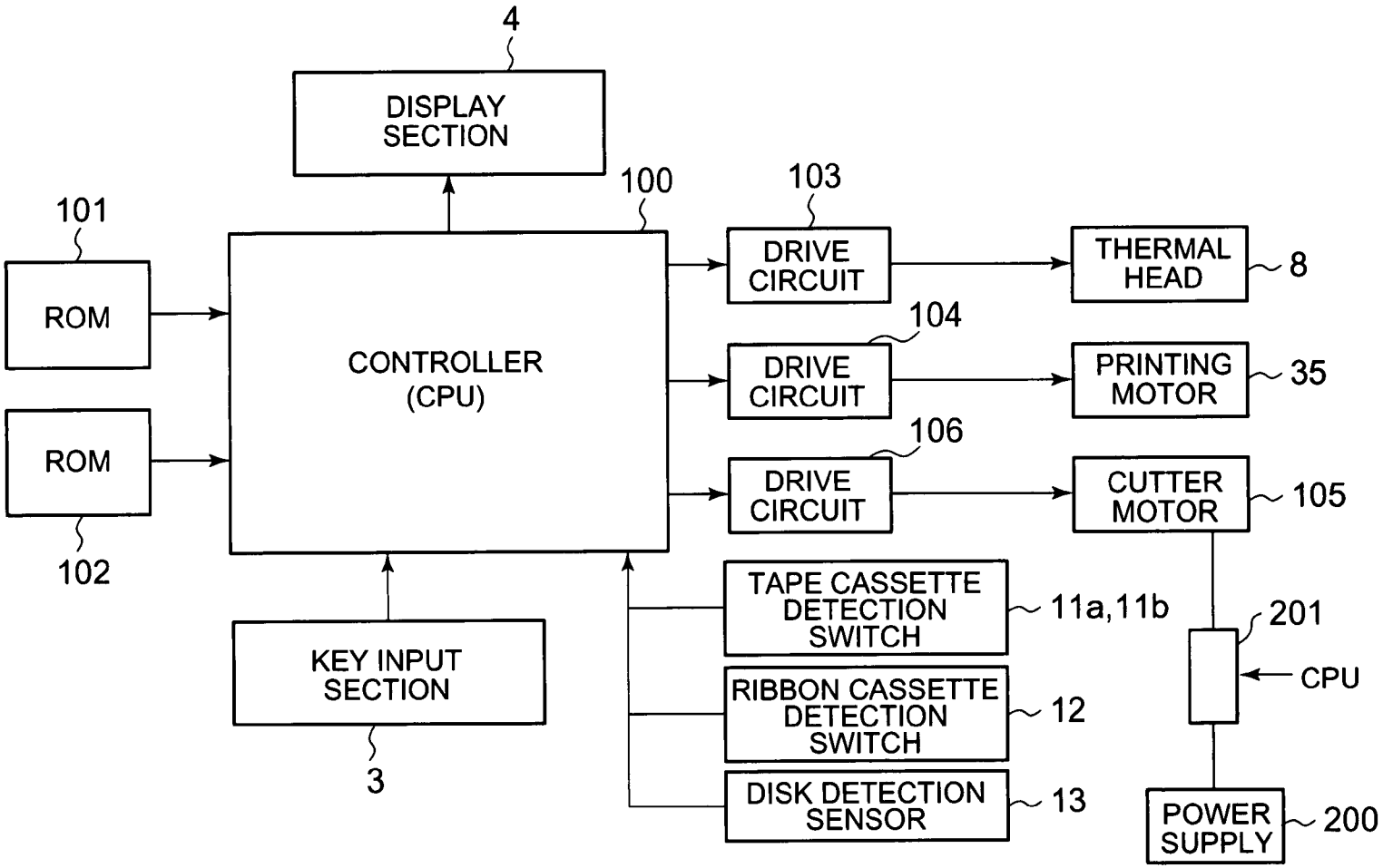
FIG. 20 is a block diagram showing the structure of an electronic circuit of the printing apparatus.

FIG. 20 is a block diagram showing the electronic circuit of the printing apparatus P according to the embodiment. The printing apparatus P has a controller (CPU) 100, which performs the general control of the printing apparatus P. The printing apparatus P also has a ROM 101 and a RAM 102.

Stored in the ROM 101 is program data, such as a system program for controlling the operations of the individual sections of the printing apparatus P. Also stored in the ROM 101 is data on an energization time table which set times for energizing the heat generating elements of the thermal head 8 according to the tape print mode to print on a table and the disk print mode to print on an optical disk D. That is, the printing apparatus P is designed in such a way that for printing on the print tape 71 and printing on the optical disk, the energization time tables corresponding to both types of printing are used to change the heat energy generated by the thermal head 8. A greater energy is applied for printing on the print tape 71 than the energy applied for printing on the optical disk.

As mentioned above, a resin-based ink is used in the ink ribbon 72 to be used in printing on the print tape 71, and a resin-added wax-based ink is used in the ink ribbon 87 to be used in printing on the optical disk D. Labels which are created using the print tape 71 are used in various locations, such as inside a room and outside a room, and used under environments and conditions different from those for optical disks D which are generally stored in a room. Therefore, printing on the print tape 71 requires higher print durabilities, such as rubfastness, chemical resistance, water proof and weather resistance, than printing a label on the optical disk D. Accordingly, thermal transfer printing on a tape is carried out using an ink ribbon with a resin-based ink excellent in print durability. The resin-based ink has a higher melting point than the wax-based ink, so that the resin-based ink when used requires greater energy than the wax-based ink. To be specific, the melting point of the resin-based ink is about 90° C., whereas the melting point of the wax-based ink is about 85° C. From the viewpoint of energy saving, therefore, the wax-based ink is used in label printing on the optical disk D, which does not require a high print durability than printing on a label.

Referring to FIG. 20, the RAM 102 has memories including an input data memory for storing input data, and a print data memory for storing print pattern data, and temporarily stores data needed for the printing operation.

The key input section 3 and the display section 4 are connected to the controller 100. Further connected to the controller 100 are a drive circuit 103, which drives the thermal head 8, a drive circuit 104, which drives the printing motor 35, and a drive circuit 106, which drives the cutter motor 105. The tape cassette detection switches 11*a* and 11*b*, the ink ribbon cassette detection switch 12 and the disk detection sensor 13 are also connected to the controller 100.

Figure 21:
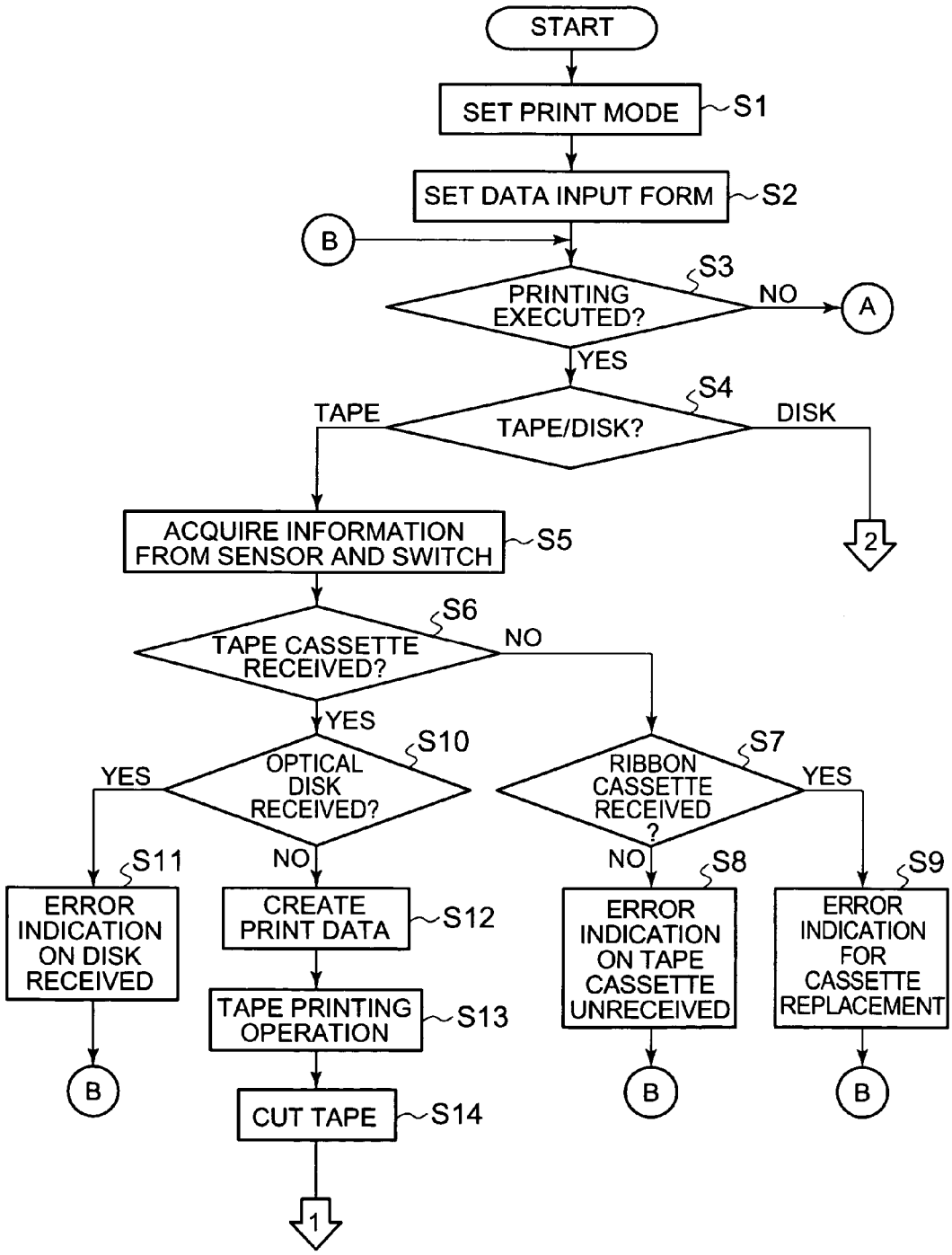
FIG. 21 is a flowchart illustrating a part of the operational flow of the printing apparatus.
Figure 22:
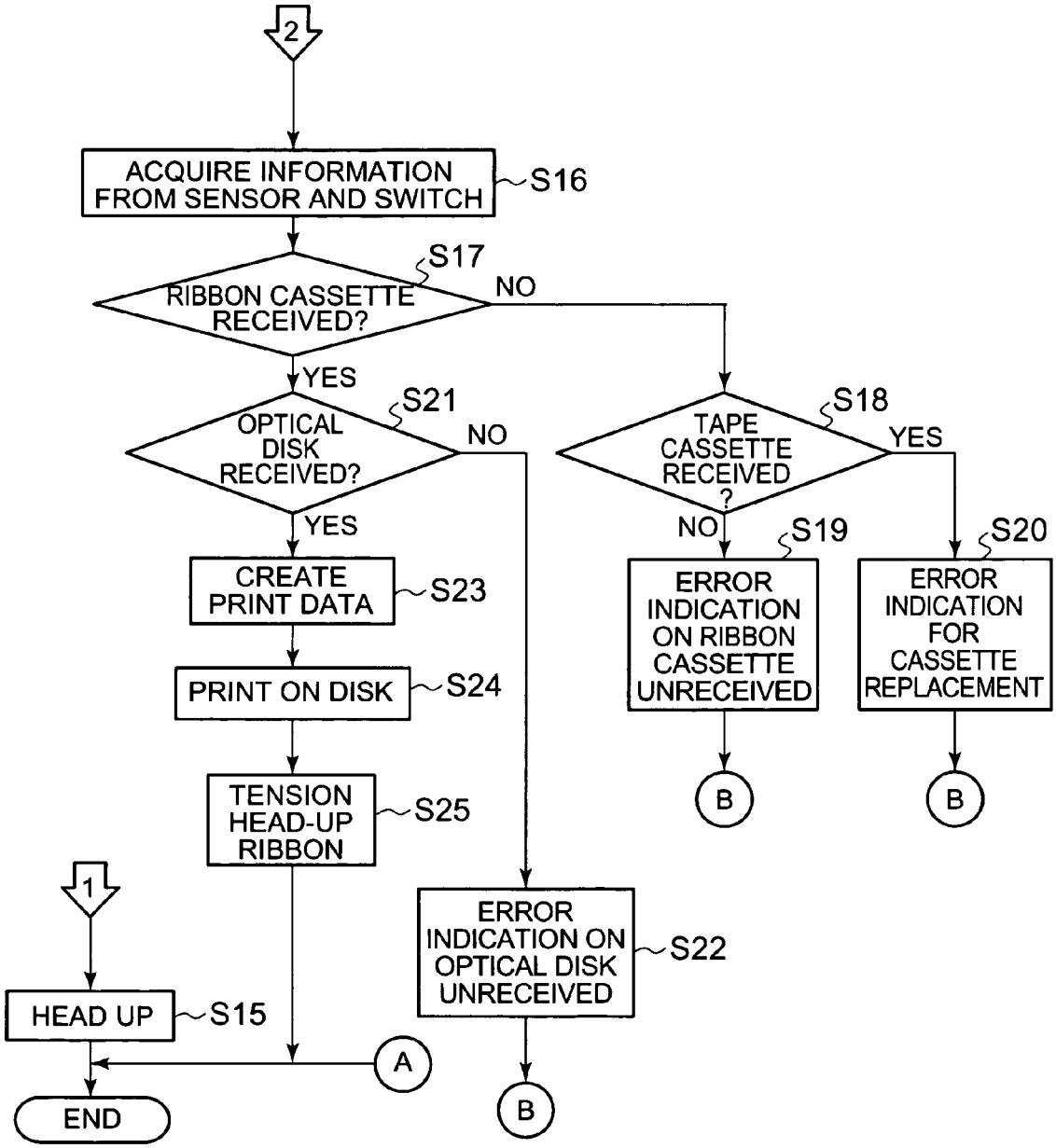
FIG. 22 is a flowchart illustrating a part of the remaining operational flow of the printing apparatus.

Next, the printing operation of the printing apparatus P will be explained. FIGS. 21 and 22 are flowcharts illustrating the flow of the print control of the printing apparatus P.

First, a menu screen for setting the tape print mode with the print tape 71 as the print target or the disk print mode with the optical disk D as the print target is displayed on the display section 4, and a user sets the print mode through the menu screen (step S1).

Next, the display section 4 displays an input edition screen and a form setting screen, and the user enters data to be printed through the key input section 3, and performs the input setting of a form, such as a character size, a linage, and a font. (step S2).

Subsequently, the controller 100 determines whether or not the execution of printing has been instructed (step S3). When the user has instructed the execution of the printing through the operation of the print key of the key input section 3, (step S3: YES), the controller 100 determines whether the set print mode is for the print tape or the optical disk (step S4). If the user instructs the termination of printing through the operation of a cancel key or the like, the controller 100 terminates the process (step S3: NO and END).

When having determined that the tape print mode has been set at the step S4, the controller 100 acquires information from the tape cassette detection switches 11*a* and 11*b*, the ink ribbon cassette detection switch 12, and the disk detection sensor 13 all provided at the receiving section 6 (step S5), and determines whether or not the tape cassette 70 is received in the receiving section 6 (step S6).

When having determined that the tape cassette 70 is not received in the receiving section 6 (step S6: NO), the controller 100 then determines whether or not the ribbon cassette 85 is received in the receiving section 6 (step S7). When having determined that the ribbon cassette 85 is not received in the receiving section 6 (step S7: NO), the controller 100 displays an error indication that the tape cassette 70 is not received on the display section 4 (step S8), and the flow stands by for the instruction to execute printing at the step S3. During this shifting, the user can put the tape cassette 70 in the receiving section 6 and instruct the execution of printing again.

When having determined that the ribbon cassette 85 is received in the receiving section 6 (step S7: YES), the controller 100 displays an error indication that the tape cassette 70 should be set instead of the ribbon cassette 85 on the display section 4 (step S9), and the flow stands by for the instruction to execute printing at the step S3. This allows the user to replace the ribbon cassette 85 received in the receiving section 6 with the tape cassette 79, and instruct the execution of printing again.

When having determined that the tape cassette 70 is received in the receiving section 6 (step S6: YES), the controller 100 determines whether or not the optical disk D is received in the receiving section 6 (step S10). When having determined that the optical disk D is received in the receiving section 6 (step S10: YES), the controller 100 displays an error indication that the optical disk D should be removed since the optical disk is received on the display section 4 (step S11), and the flow stands by for the instruction to execute the printing at the step S3. This permits the user to remove the optical disk D received in the receiving section 6 and instruct the execution of the printing again.

When having determined that the tape cassette 70 is received in the receiving section 6 (step S6: YES) and the optical disk D is not received in the receiving section 6 (step S10: NO), the controller 100 creates print data of the input data based on tape cassette information such as the set format and the width of the captured tape (step S12). The controller 100 drives the printing motor 35, to carry out the movement of the thermal head 8 toward the print position, explained referring to FIG. 14, and the rotation of the platen roller 7 and ribbon winding shaft 9, explained referring to FIG. 15, thereby feeding the print tape 71 and the ink ribbon 72 overlapping each other, and to drive the heating elements of the thermal head 8 to generate heat according to the print data, thereby thermally transferring the ink of the ink ribbon 72 onto the print tape 71 to do printing. In this case, the thermal head 8 is driven according to the energization time table for tape printing stored in the ROM 102 (step S13).

After the printing is finished, the cutting mechanism 17 is driven by the cutter motor 105 with the thermal head 8 pressed against the platen roller 7, and the movable blade 17*b* is operated to cut the print tape 71 (step S14). Further, as discussed referring to FIG. 16, the printing motor 35 is driven reversely to separate the thermal head 8 from the platen roller 7 (head-up), and then terminates the process (step S15, and END).

When it is determined at the step S4 that the set print mode is the disk print mode, the controller 100 acquires the information from the tape cassette detection switches 11*a*, 11*b*, the ink ribbon cassette detection switch 12, and the disk detection sensor 13, all provided at the receiving section 6 (step S16), and then determines whether or not the ribbon cassette 85 is received in the receiving section 6 based on the information from the ink ribbon cassette detection switch 12 (step S17).

When having determined that the ribbon cassette 85 is not received in the receiving section 6 (step S17: NO), the controller 100 then determines whether or not the tape cassette 70 is received in the receiving section 6 (step S18). When having determined that the tape cassette 70 is not received in the receiving section 6 (step S18: NO), the controller 100 displays an error indication that the ribbon cassette 85 is not received in the receiving section 6 on the display section 4 (step S19), and the flow stands by for the instruction to execute printing at the step S3. This error indication permits the user to put the ribbon cassette 85 in the receiving section 6 and instruct the execution of printing again.

When having determined that the tape cassette 70 is received in the receiving section 6 (step S18: YES), the controller 100 displays an error indication that the tape cassette 70 should be replaced with the ribbon cassette 85 on the display section 4 (step S20), and the flow stands by for the instruction execute the printing at the step S3. This permits the user to replace the tape cassette 70 received in the receiving section 6 with the ribbon cassette 85, and instruct the execution of printing again.

When having determined that the ribbon cassette 85 is received in the receiving section 6 (step S17: YES), the controller 100 then determines whether or not the optical disk D is received in the receiving section 6 (step S21). When having determined that the optical disk D is not received in the receiving section 6 (step S21: NO), the controller 100 displays an error indication indicating that the optical disk D is unreceived in the receiving section 6 (step S22), and the flow stands by for the instruction to execute printing at the step S3. This allows the user to put the optical disk D in the receiving section 6 and instruct the execution of the printing again.

When having determined that the ribbon cassette 85 is received in the receiving section 6 (step S17: YES), and the optical disk D is received in the receiving section 6 (step S21: YES), the controller 100 creates the print data of data input based on the set form (step S23), drives the printing motor 35 in the forward direction to move the thermal head 8 toward the print position as illustrated in FIG. 14, and to rotate the platen roller 7 and the ribbon winding shaft 9 as illustrated in FIG. 15, thereby feeding the optical disk D and the ink ribbon 87 overlapping each other, and to drive the heating elements of the thermal head 8 is so driven as to generate heat according to the print data, thereby thermally transferring the ink of the ink ribbon 87 onto the label side of the optical disk D to do printing. In this case, the thermal head 8 is driven according to the energization time table for disk printing stored in the ROM 102 (step S24).

When the printing is finished, the optical disk D is carried to the position of the ejection section 14, and halted in a state where more than or equal to the half of the area portion on the upper side of the carrying direction is supported above the ejection section 14. Next, as explained referring to FIGS. 16 and 17, the printing motor 35 is reversely driven, thereby separating the thermal head 8 from the platen roller 7, and the printing motor 35 is reversely driven for a predetermined time to tension the ink ribbon 87, after which the process is terminated (step S25, and END).

Next, an explanation will be given of another example of the print operation of the printing apparatus P based on the flowchart in FIG. 23.

In addition to the aforementioned general resin tape, a magnetic tape which immixes magnetic materials therein and magnetizes them, and a reflective tape which immixes glass powder are prepared as the print tapes. The printing apparatus P is capable of printing on those tape materials. Because those particular tape materials have larger hardness than that of the resin tape, and cutting those particular tape materials may be likely to cause problems in the durability of the stationary and movable blades of the cutting mechanism 17. Accordingly, it is contemplated that the tape is to be cut by separate scissors without performing the cutting process by the cutting mechanism 17 loaded on the printing apparatus P after the tape printing. Setting on whether or not to operate the cutting mechanism 17 based on determination made by the user can be made in the printing apparatus P.

Figure 23:
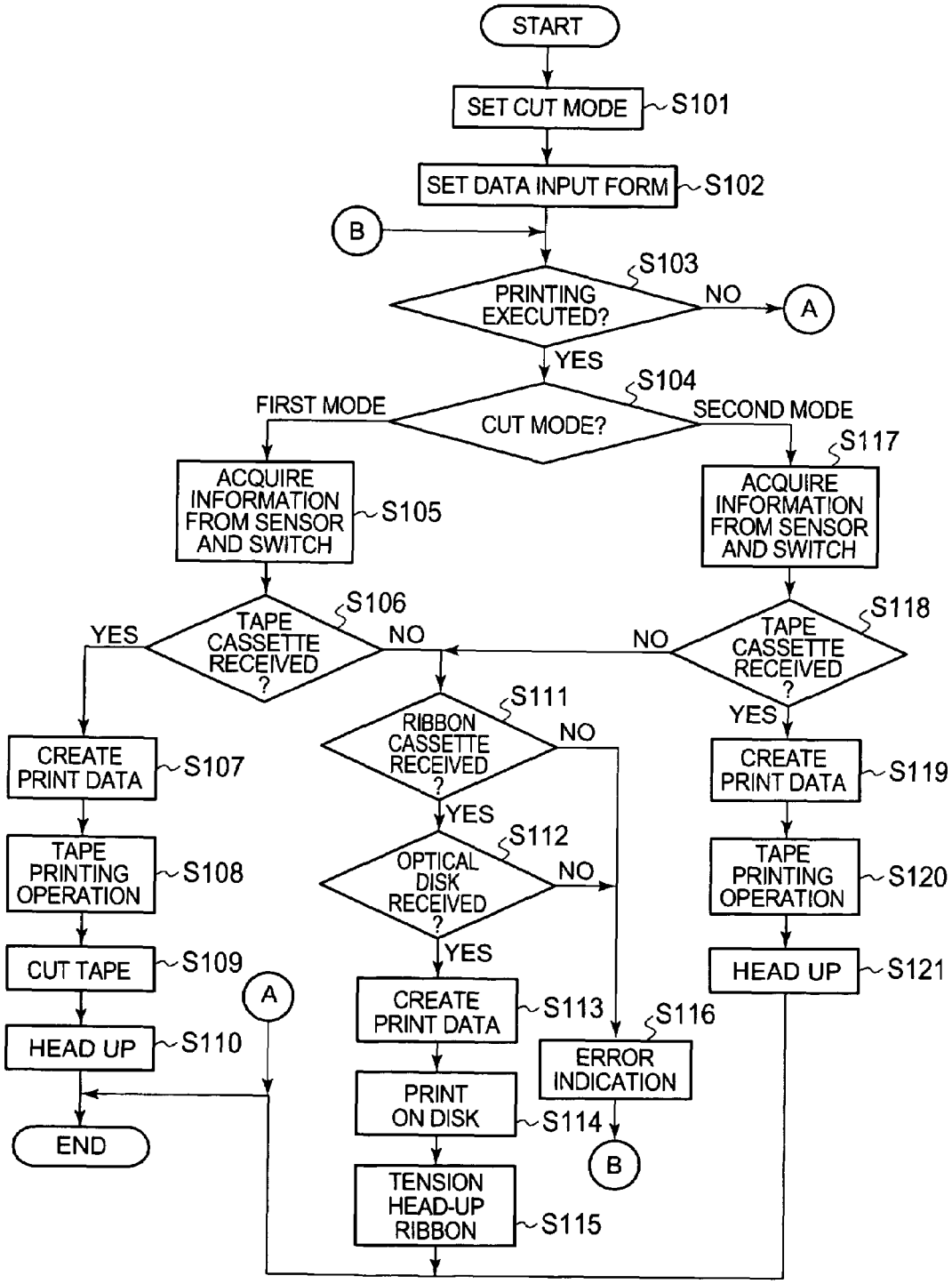
FIG. 23 is a flowchart illustrating another operational flow of the printing apparatus.

In FIG. 23, first, a menu screen for setting the first mode of cutting the print target or the second mode of not cutting the print target is displayed on the display section 4, and the user sets the cut mode through the menu screen (S101).

Next, the display section 4 displays an input edition screen and a form setting screen, and the user enters data to be printed through the key input section 3, and carries out the input setting of a form, such as a character size, a linage, and a font. (S102).

Subsequently, the controller 100 determines whether or not the execution of printing based on the operation of the print key of the key input section 3 is instructed (S103). If the execution of the printing is instructed (S103: YES), the controller 100 determines whether the set cut mode is the first mode or the second mode (S104). If the execution of the printing is not instructed, the process is terminated (S103: NO).

In a case where the first mode is set, the controller 100 acquires information from the tape cassette detection switches 11*a* and 11*b*, the ribbon cassette detection switch 12, and the disk detection sensor 13 all provided at the receiving section 6 (S105), and determines whether or not the tape cassette 70 is received in the receiving section 6 based on the information from the tape cassette detection switches 11*a* and 11*b* (S106).

When having determined that the tape cassette 70 is received in the receiving section 6 (S106: YES), the controller 100 creates print pattern data of data input based on tape cassette information such as the set form, and the width of the captured tape (S107). The printing motor 35 is driven to press the thermal head 8 against the platen roller 7, and rotate the platen roller 7 and the ribbon winding shaft 9, and the heating elements of the thermal head 8 are so driven as to generate heat according to the print data, thereby thermally transferring the ink of the ink ribbon 72 onto the print tape 71 to do printing. In this case, the energizing time of the thermal head 8 id decided based on the energization time table for tape printing (S108).

After printing is completed, the cutting mechanism 17 is driven by the cutter motor 105 with the thermal head 8 pressed against the platen roller 7, and the movable blade 17*b* is so operated as to cut the print tape 71 (S109), and the printing motor 35 is reversely rotated, thereby separating the thermal head 8 from the platen roller 7, and the process is terminated (S110, END).

When having determined that the tape cassette 70 is not received in the receiving section 6 (S106: NO), the controller 100 then determines whether or not the ribbon cassette 85 is received in the receiving section 6 (S111). When having determined that the ribbon cassette 85 is received in the receiving section 6 (S111: YES), the controller 100 then determines whether or not the optical disk D is received in the receiving section 6 (S112). When having determined that the optical disk D is received in the receiving section 6 (S112: YES), the controller 100 creates print data of data input based on the set form (S113), rotates the printing motor 35 forwardly to press the thermal head 8 against the platen roller 7 and rotate the platen roller 7 and the ribbon winding shaft 9, and the heating elements of the thermal head 8 are so driven as to generate heat according to the print data, thereby thermally transferring the ink of the ink ribbon 87 onto the label side A of the optical disk D to do printing. In this case, the energization time of the thermal head 8 is decided based on the energization time table for disk printing (S114). In this case, although it is the first mode of carrying out the cutting, the cutter motor 105 is not driven.

When printing is completed, the printing motor 35 is reversely rotated, thereby separating the thermal head from the platen roller 7, and the printing motor 35 is further rotated reversely for a certain period of time to tension the ink ribbon 87, after which the process is terminated (S115, and END).

When having determined that the ribbon cassette 85 is not received in the receiving section 6 (S111: NO) and the optical disk D is not received in the receiving section 6 (S112: NO), the display section 4 displays error indications (S116), and the flow stands by for the instruction to execute printing at the step S103.

When having determined that the cut mode set at the step S104 is the second mode, the controller 100 acquires the information from the tape cassette detection switches 11*a* and 11*b*, the ribbon cassette detection switch 12, and the disk detection sector 13, all provided at the receiving section 6 (S117), and determines whether or not the tape cassette 70 is received in the receiving section 6 based on the information from the tape cassette detection switches 11*a* and 11*b* (S118).

When having determined that the tape cassette 70 is received in the receiving section 6 (S118: YES), the controller 100 creates print data of data input based on tape cassette information such as the set form, and the width of the captured tape (S119). Then, the printing motor 35 is driven to press the thermal head 8 against the platen roller 7, and rotate the platen roller 7 and the ribbon winding shaft 9, and the heating elements of the thermal head 8 are so driven as to generate heat according to the print data, thereby thermally transferring the ink of the ink ribbon 72 onto the print tape 71 to do printing (S120). After the completion of printing, the tape is not cut, and the printing motor 35 is reversely rotated, thereby separating the thermal head 8 from the platen roller 7, after which the process is terminated (S121, and END).

When having determined that the tape cassette 70 is not received in the receiving section 6 at the step S118, the controller 100 executes the processes of the steps S111 to 116. In this case, the cutter motor 105 is not driven at the time of printing on the optical disk D, too.

When the optical disk D is received in the receiving section 6, the reception of the optical disk D in the receiving section 6 may be detected by the disk detection sensor 13 and the power supply to the cutter motor 105 may be shut off. Reference number 200 in FIG. 20 denotes a power supply section which supplies drive power to the individual sections of the apparatus including the cutter motor 105. The power is supplied to the cutter motor 105 from the power supply section 200 through a switching device 201. When the optical disk D is detected based on detection information of the disk detection sensor 13, the controller 100 controls the switching device 201 to shut off the power supply to the cutter motor 105. This makes it possible to prevent the cut operation on the optical disk D.

Figure 24:
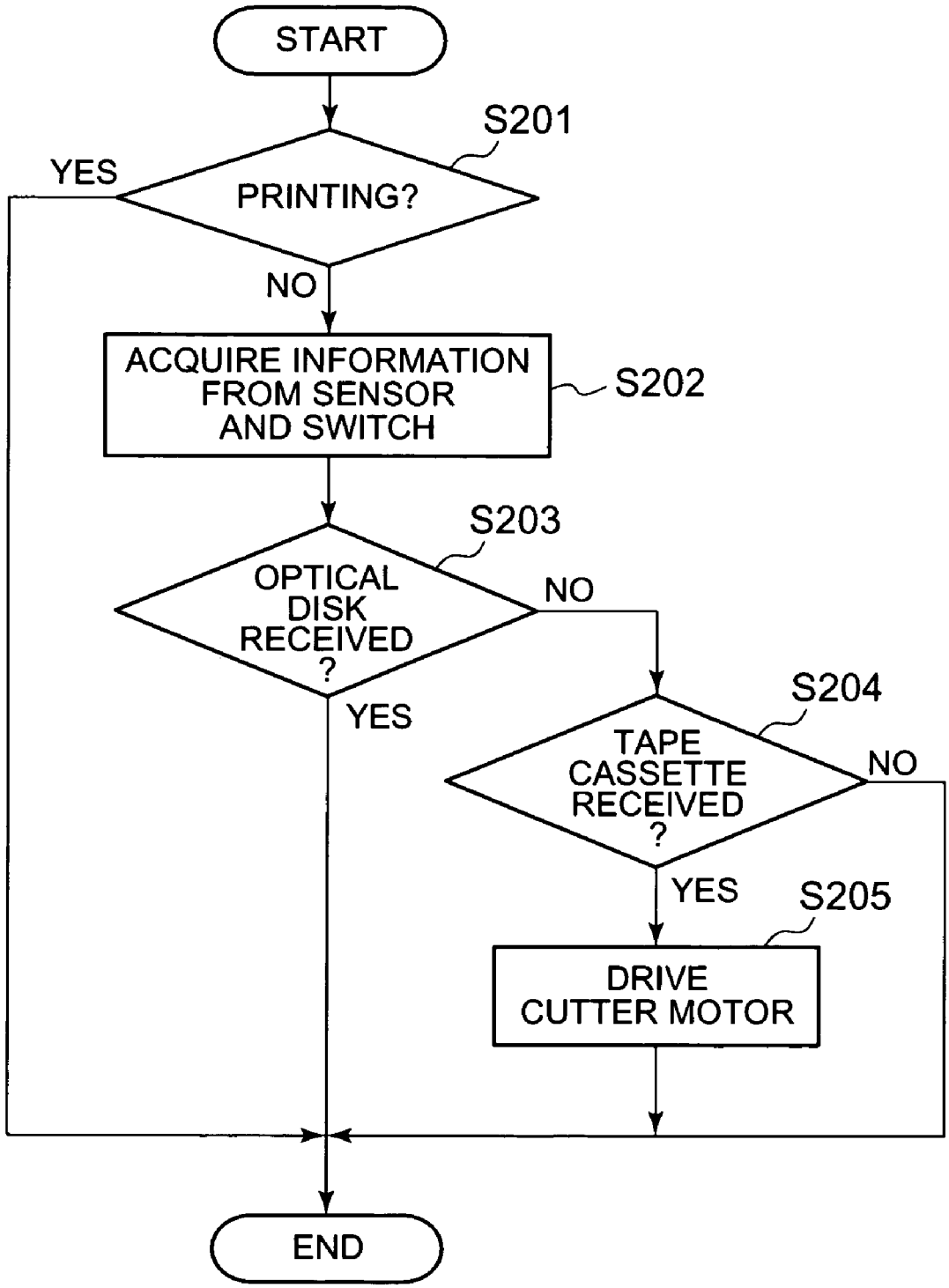
FIG. 24 is a flowchart illustrating a process when a cutter key is operated.

FIG. 24 illustrates control in a case where the cutting mechanism 17 is manually forced to operate. The key input section 3 of the printing apparatus P is provided with the cutter key, and the operation of the cutter key causes the cutter motor 105 to operate, and the cutting mechanism 17 carries out the cutting. The forced operation of the cutting mechanism 17 by the cutter key is carried out when alignment of the position of the leading end of the print tape 71 with a predetermined position is desired by cutting the leading end of the print tape 71 at the time of receiving the tape cassette 70 in the receiving section 6 of the printing apparatus P.

The operation of the cutter key starts the process illustrated in FIG. 24, and the controller 100 first determines whether or not the printing operation is in progress (S201). If the printing operation is in progress, the operation of the cutter key becomes invalid (S201: YES and END). If the printing operation is not in progress, (S201: NO), the controller 100 acquires information from the tape cassette detection switches 11*a* and 11*b*, and the optical disk detection sensors 13 and 13*a*, all provided at the receiving section 6 (S202), and then determines whether or not the optical disk D is received in the receiving section 6 (S203). When having determined that the optical disk D is received, the operation of the cutter key becomes invalid (S203: YES and END).

When having determined that the optical disk D is received (S203: NO), the controller 100 then determines whether or not the tape cassette 70 is received (S204). When having determined that the tape cassette 70 is received, the controller 100 drives the cutter motor 105 to operate the cutting mechanism 17 (S205). When having determined that the tape cassette 70 is not received at the step S204, the operation of the cutter key becomes invalid (S204: NO and END).

Thus, if the tape cassette 70 is received in the receiving section 6, the cutting mechanism 17 is forcibly operated to cut the tape by the operation of the cutter key, whereas if the optical disk D is received in the receiving section 6, the operation of the cutter key is invalidated, thereby avoiding accidental cutting and breaking of the optical disk D.

In the above-described embodiment, the print tape 71 and the optical disk D are carried along the common feed passage, and the printing section common to the print tape 71 and the optical disk D and the cutter adapted only for the print tape 71 are laid out to face the common feed passage. However, the printing apparatus may be structured in such a way that two exclusive feed passages are provided at the downstream of the printing section respectively for the print tape 71 and the optical disk D, and the cutter may be provided in the exclusive feed passage for the print tape 71. In this case, it is desirable that the cutter should be operated at the time of printing on the print tape 71 and should not be operated at the time of printing on the optical disk D, thereby avoiding an unnecessary operation.

Although the explanation has been given of the printing apparatus of the type that moves the printing tape 71 or the optical disk D in the print direction with the thermal head 8 fixed, the present invention can be applied to a printing apparatus of a type which moves the thermal head with the print target fixed.

INDUSTRIAL APPLICABILITY

As explained above according to the invention, it is possible to provide a printing apparatus which is so structured as to be capable of printing on a print tape as well as a recording medium, and inhibiting the operation of the cutter with respect to the recording medium while allowing the cutter to be operable only for the print tape.

Various embodiments and changes may be made thereunto without departing from the broad spirit and scope of the invention. The above-described embodiment is intended to illustrate the present invention, not to limit the scope of the present invention. The scope of the present invention is shown by the attached claims rather than the embodiment. Various modifications made within the meaning of an equivalent of the claims of the invention and within the claims are to be regarded to be in the scope of the present invention.

This application is based on Japanese Patent Application No. 2004-299326 filed on Oct. 13, 2004 and including specification, claims, drawings and summary. The disclosure of the above Japanese Patent Application is incorporated herein by reference in its entirety.

What is claimed is:

1. A printing apparatus which selectively printing on a print tape and a hard hard medium as different print targets and comprises:

a single printing section which can perform printing on the print tape or the hard medium;

a cutter which cuts the print tape on which printing is performed by the printing section;

a detector which detects the print target retained in a main body; and a controller which controls the printing section and the cutter, activates the printing section and performs printing on the print tape or the hard medium, and permits or inhibits an operation of the cutter based on detection information of the print tape or the hard medium detected by the detector.

2. The printing apparatus according to claim 1, further comprising a printing-mode-setting section which sets a first printing mode of printing on the print tape, and a second printing mode for printing on the hard medium, wherein the controller activates the printing section to print on the print tape and activates the cutter for cutting the print tape on which printing is performed by the printing section when the first printing mode is set by the printing mode setting section and the detection section detects the print tape as the print target, and activates the printing section to print on the hard medium and performs controlling as to inhibit the operation of the cutter when the second printing mode is set by the printing mode setting section and the detection section detects the hard medium as the print target.

3. The printing apparatus according to claim 2, further comprising an alarm section which alarms an error when the first printing mode is set by the printing-mode-setting section but the detection section detects that the print target is not the print tape, and when the second printing mode is set by the printing mode setting section but the detection section detects that the print target is not the hard medium.

4. The printing apparatus according to claim 2, wherein the controller inhibits operations of the printing section and cutter when the first printing mode is set by the printing mode setting section but the detection section detects that the print target is not the print tape, and when the second printing mode is set by the printing mode setting section but the detection section detects that the print target is not the hard medium.

5. The printing apparatus according to claim 1, further comprising a cutting-mode setting section which can set a first cutting mode of cutting the print target and a second cutting mode of not cutting the print target, wherein in a case where the first cutting mode is set by the cutting-mode setting section, the controller performs controlling as to permit operations of the printing section and cutter when the detection section detects the print tape as the print target, and performs controlling as to permit the operation of the printing section and inhibit the operation of the cutter when the detection section detects the hard medium as the print target.

6. The printing apparatus according to claim 1, further comprising a forced-operation instruction section which generates an instruction to force the cutter to operate, wherein the controller activates the cutter in accordance with the instruction from the forced-operation instruction section when the detection section detects the print tape, and inhibits the operation of the cutter regardless of the instruction of the forced-operation instruction section when the detection section detects the hard medium.

7. The printing apparatus according to claim 1, wherein the printing section has a thermal head, the print tape is held together with an ink ribbon by a tape cassette and retained in the main body, and the hard medium is retained in the main body together with a ribbon cassette holding an ink ribbon, and the printing section thermally transfers ink of the ink ribbon onto the print tape and ink of the ink ribbon of the ribbon cassette onto the hard medium.

8. The printing apparatus according to claim 1, wherein the detection section comprises a first detection section which detects that the print tape is retained in the main body, and a second detection section which detects that the hard medium is retained in the main body.

9. The printing apparatus according to claim 1, further comprising a carrying section which carries the print tape and the hard medium along a common carrying path on which the printing section and the cutter are so placed as to face that path.

10. The printing apparatus according to claim 1, wherein the hard medium is a recording medium in which electronic data is recordable.

11. The printing apparatus according to claim 1, further comprising a carrying section which carries the print target, wherein the printing section performs printing by thermally transferring ink of an ink ribbon onto the print target while the carrying section is carrying the print target.

12. The printing apparatus according to claim 11, wherein the carrying section carries the print target together with the ink ribbon.

13. The printing apparatus according to claim 11, further comprising a section which carries the print target together with the ink ribbon in conjunction with the carrying section.

* * * * *